United States Patent [19]

Foster

[11] Patent Number: 4,532,854

[45] Date of Patent: Aug. 6, 1985

[54] SELECTIVELY OPERATIVE MULTI-DISPLACEMENT PUMP OR MOTOR

[75] Inventor: Kenneth W. S. Foster, Cheshire, England

[73] Assignee: Renold Plc, A British Company of Renold House, Manchester, England

[21] Appl. No.: 563,659

[22] Filed: Dec. 20, 1983

[30] Foreign Application Priority Data

Dec. 24, 1982 [GB] United Kingdom ..... 8236792

[51] Int. Cl.[3] ..... F01B 13/06

[52] U.S. Cl. ..... 91/472; 91/491; 91/492; 91/498

[58] Field of Search ..... 91/472, 491, 492, 497, 91/498

[56] References Cited

U.S. PATENT DOCUMENTS

| | | | |
|---|---|---|---|
| 2,160,612 | 5/1939 | Alpern | 91/492 |
| 3,593,621 | 7/1971 | Praddande | 91/498 |
| 3,661,057 | 5/1972 | Rogov | 91/498 X |
| 3,760,691 | 9/1973 | Kleckner et al. | 91/472 X |
| 4,157,056 | 6/1979 | Allart et al. | 91/491 |
| 4,356,761 | 11/1982 | Cameron-Johnson et al. | 91/492 X |
| 4,398,450 | 8/1983 | Louhio | 91/497 X |
| 4,404,896 | 9/1983 | Allart et al. | 91/491 |

FOREIGN PATENT DOCUMENTS

| | | | |
|---|---|---|---|
| 2127268 | 10/1972 | France . | |
| 2292877 | 6/1976 | France . | |
| 1063673 | 3/1967 | United Kingdom . | |
| 1065227 | 4/1967 | United Kingdom . | |
| 1114080 | 5/1968 | United Kingdom . | |
| 1242381 | 8/1971 | United Kingdom . | |
| 1322891 | 7/1973 | United Kingdom | 91/492 |
| 1384451 | 2/1975 | United Kingdom . | |
| 1413109 | 11/1975 | United Kingdom . | |
| 1413107 | 11/1975 | United Kingdom . | |
| 1413108 | 11/1975 | United Kingdom . | |
| 2075131 | 11/1981 | United Kingdom | 91/492 |
| 193243 | 4/1967 | U.S.S.R. | 91/492 |

*Primary Examiner*—William L. Freeh
*Assistant Examiner*—Paul F. Neils
*Attorney, Agent, or Firm*—Frishauf, Holtz, Goodman & Woodward

[57] ABSTRACT

A hydraulic piston and cylinder machine includes a plurality of pistons and cylinders, a ring of ports for alternatively supplying fluid into, and for allowing the fluid to be discharged from each cylinder, and a cam having a plurality of lobes to control the displacement of the pistons in a cylinder block with respect to the progression of the cylinder block along the direction of the cam or vice versa. Each of the pistons traverses each of the cam lobes during a full rotation of the machine to undergo a number of piston strokes equal to the number of lobes. A control valve is adjustable to route working fluid discharged through at least one of the fluid discharge ports of the machine to the exhaust fluid outlet of the machine during each full rotation of the machine via an isolated pressure zone of the machine. In this zone the pressure of fluid is maintained at a level intermediate the supply and exhaust pressures of working fluid to and from the machine, so as to reduce the capacity of the machine to receive and discharge working fluid. The isolated pressure zone is of constant volume and always includes, at any given time, the cylinders associated with at least two pistons of the machine.

16 Claims, 25 Drawing Figures

SELECTIVELY OPERATIVE MULTI-DISPLACEMENT PUMP OR MOTOR

This invention relates to hydraulic piston and cylinder machines.

In hydraulic piston and cylinder machines of the type having a plurality of pistons and cylinders, a ring of ports for alternatively supplying fluid into and for allowing it to be discharged from each cylinder and a cam having a plurality of lobes to control the displacement of the pistons in a cylinder block with respect to the progression of the cylinder block along the direction of the cam or vice versa, and in which each of the pistons traverses each of the cam lobes during a full rotation of the machine to undergo a number of piston strokes equal to the number of lobes, it is known to design the machine such that the forces acting on the pistons are balanced, the sum of the velocities of the pistons remain constant and the contact stress between the cam track and the cam follower elements on the pistons is limited to improve the fatigue life of the cam.

Optimum designs within this framework which take account of differences dictated by the basic specification for the design, give rise to different geometries for the machine but in the main, the most common arrangements employ six pistons and cylinders and four cam lobes, eight or nine pistons and cylinders and three cam lobes and eight or nine pistons and cylinders and six cam lobes. However, hydraulic piston and cylinder machines employing higher numbers of pistons and cylinders and cam lobes are also used.

The preferred geometries using lower numbers of pistons and cylinders and cam lobes give rise to lighter and more compact designs of machines.

In many applications of hydraulic piston and cylinder machines used as hydraulic motor drives, e.g. in vehicle applications, the very highest torque output requirement of the motor under maximum pressure conditions is generally called for at lowest speed and the maximum speed requirement of the motor is only at lower pressure. In order to extend the speed range of such hydraulic motor drives, it has been proposed to switch the motor from full capacity to a reduced capacity to receive hydraulic fluid, to produce a higher speed with lower torque output with the same inflow of hydraulic fluid from the hydraulic pump which drives the motor. This has been accomplished in a number of fashions.

Thus, British Patent Specification No. 1,413,109 describes an hydraulic motor having a plurality of rows of radial pistons and cylinders and a plurality of rings of ports, and a linearly adjustable valve means adjusts the number of rings of ports in communication with the pressure fluid inlet and the exhaust fluid outlet of the motor, to operate a selected number of the rows of pistons and cylinders to provide for different motor speeds for a given delivery of working fluid to the motor. The valve means may connect the non-operative row or rows of pistons and cylinders with the exhaust fluid outlet of the motor or with a space within the motor casing vented to atmospheric pressure.

British Patent Specification No. 1,065,227 describes an hydraulic motor having a single row of pistons and cylinders, two rings of ports associated with different groups of pistons and cylinders respectively, and a linearly adjustable valve means for selecting one or both groups of pistons and cylinders for operation. The non-selected pistons and cylinders may be interconnected in a closed, substantially fluid tight system as described in British Patent Specification No. 1,063,673 in which the sum of the volumes of the cylinders of the non-selected pistons and cylinders not being fed with pressure fluid remains constant whatever the angular position of the cylinder block relative to the multi-lobe cam may be. The purpose of this so-called "stuffing" arrangement is to ensure that the piston followers of the pistons of the non-operative pistons and cylinders are still constrained to follow the lobes of the cam so that the non-operative pistons are unable to move in an uncontrolled fashion to produce troublesome, out of balance forces or possibly to strike the cam track with great force thereby damaging the cam and the piston followers.

In a further known step capacity system, half displacement is achieved by 50% of the pistons on the return stroke being arranged in part to feed 25% of the pistons which are idling, the working fluid displaced by these pistons otherwise being returned directly to the exhaust fluid outlet. The remaining 25% of the pistons are in a working stroke. The motor operates at twice the normal speed and half the normal torque, compared to full displacement operation, all the pistons, nevertheless, being controlled.

The isolation of certain pistons and cylinders and the fluid pressure control of the non-operative pistons to provide for dual capacity hydraulic motors is a satisfactory solution to the requirement for two speed motors in the case of hydraulic motors having a large number of pistons and cylinders. In compact, comparatively lightweight designs of hydraulic motors however, where the full capacity of the motor is provided by a comparatively small number of pistons and cylinders and a single multi-lobe cam having a small number of lobes, it is not practical to adopt these known techniques and an improved technique is required. The impracticality of adopting the known techniques to hydraulic motors having compact geometries is the relatively high out of balance forces which arise when operating at reduced displacement. Thus, for example, when using the "stuffing" technique, the pistons connected in a closed system and not fed with pressure fluid make no contribution to the relief of out of balance forces.

The present invention provides an hydraulic piston and cylinder machine of the type referred to at the beginning of this specification having valve means adjustable to route working fluid discharged through at least one of the fluid discharge ports of the machine to the exhaust fluid outlet of the machine during each full rotation of the machine via an isolated pressure zone of the machine in which the pressure of fluid is maintained at a pressure intermediate the supply and exhaust pressures of working fluid to and from the machine, said isolated pressure zone being of constant volume and always including, for the time being, the cylinders of at least two pistons and cylinders of the machine.

With this arrangement, the pistons and cylinders at the intermediate pressure are non-operative to produce a net output torque from the machine when the machine is operated as a motor since one at least of these cylinders receives, on the outstroke of its piston, fluid at the intermediate pressure from the intermediate pressure zone into which a corresponding volume of fluid is discharged by the other non-operative piston and cylinder or pistons and cylinders. The non-operative pistons and cylinders are effectively isolated and the flow of working fluid to the operative pistons and cylinders of the machine is effectively increased to increase the speed of the machine when the machine is operated as a motor. At the same time, the pistons of the non-operative pistons and cylinders are effectively controlled and a continuous, controlled flow of working fluid is exchanged between the operative and non-operative cylinders which regulates the pressure in the intermediate pressure zone to a predetermined proportion of the supply pressure, thus enabling the non-operative pistons to assist in mitigating the out of balance forces. This makes it practical to construct split capacity motors with a wider range of possible geometries.

Preferably, the intermediate pressure is maintained approximately half way between the pressure of working fluid supplied to the machine and the pressure of fluid exhausting from the machine when the machine is operated as a motor. This maintains symmetry for equal reverse performance of the machine and manufacturing economy.

The invention will be better understood from a consideration of the following description of specific embodiments thereof given by way of example with reference to the accompanying drawings in which different embodiments of hydraulic piston and cylinder machines in accordance with the present invention are illustrated and throughout which corresponding parts are indicated by the same reference letters or reference numerals.

Figure 11:
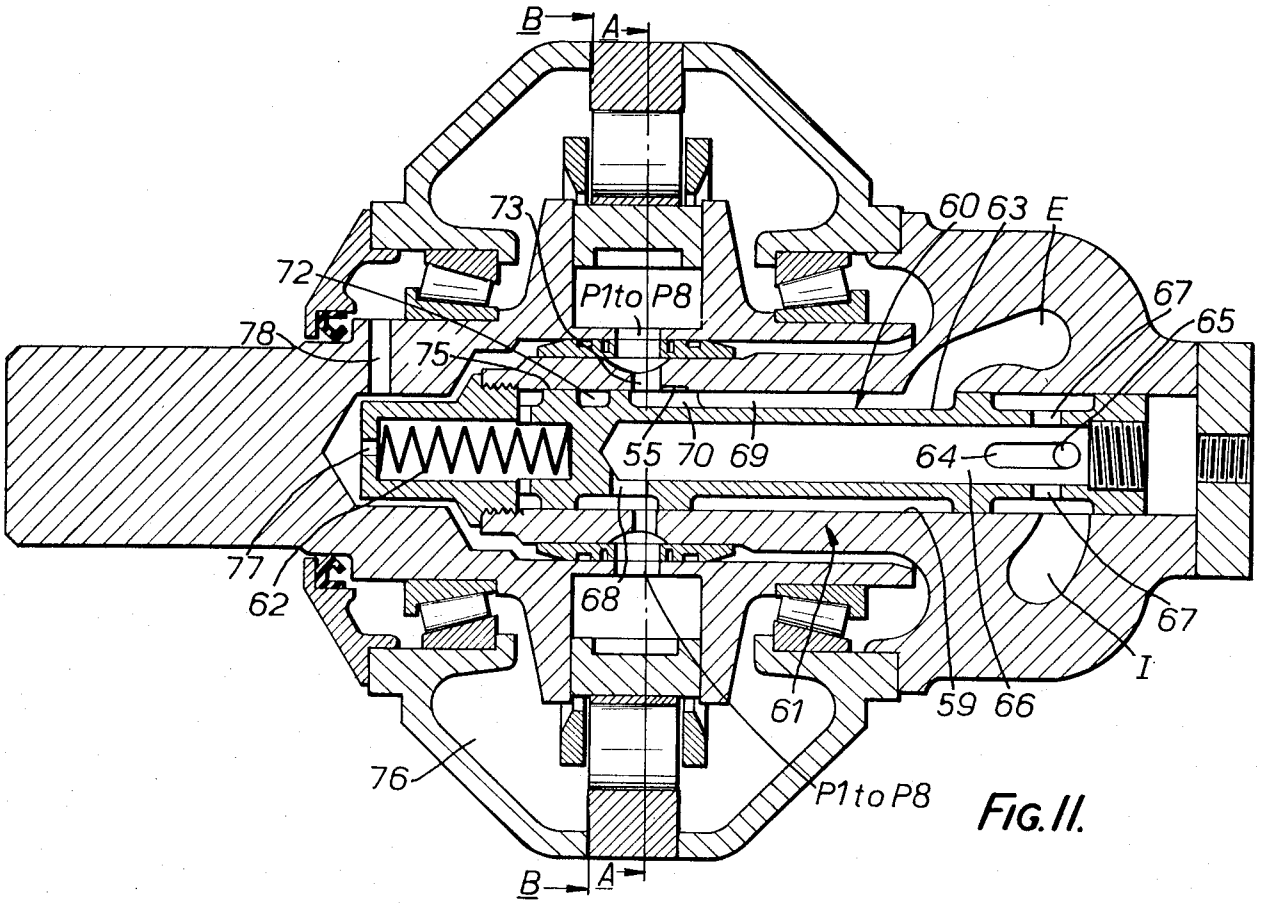
FIG. 11 is a cross-section through a complete, two speed, hydraulic motor assembly of the present invention having six pistons and cylinders and four cam lobes and showing a valve spool of the valve means in a full capacity flow setting.
Figure 12:
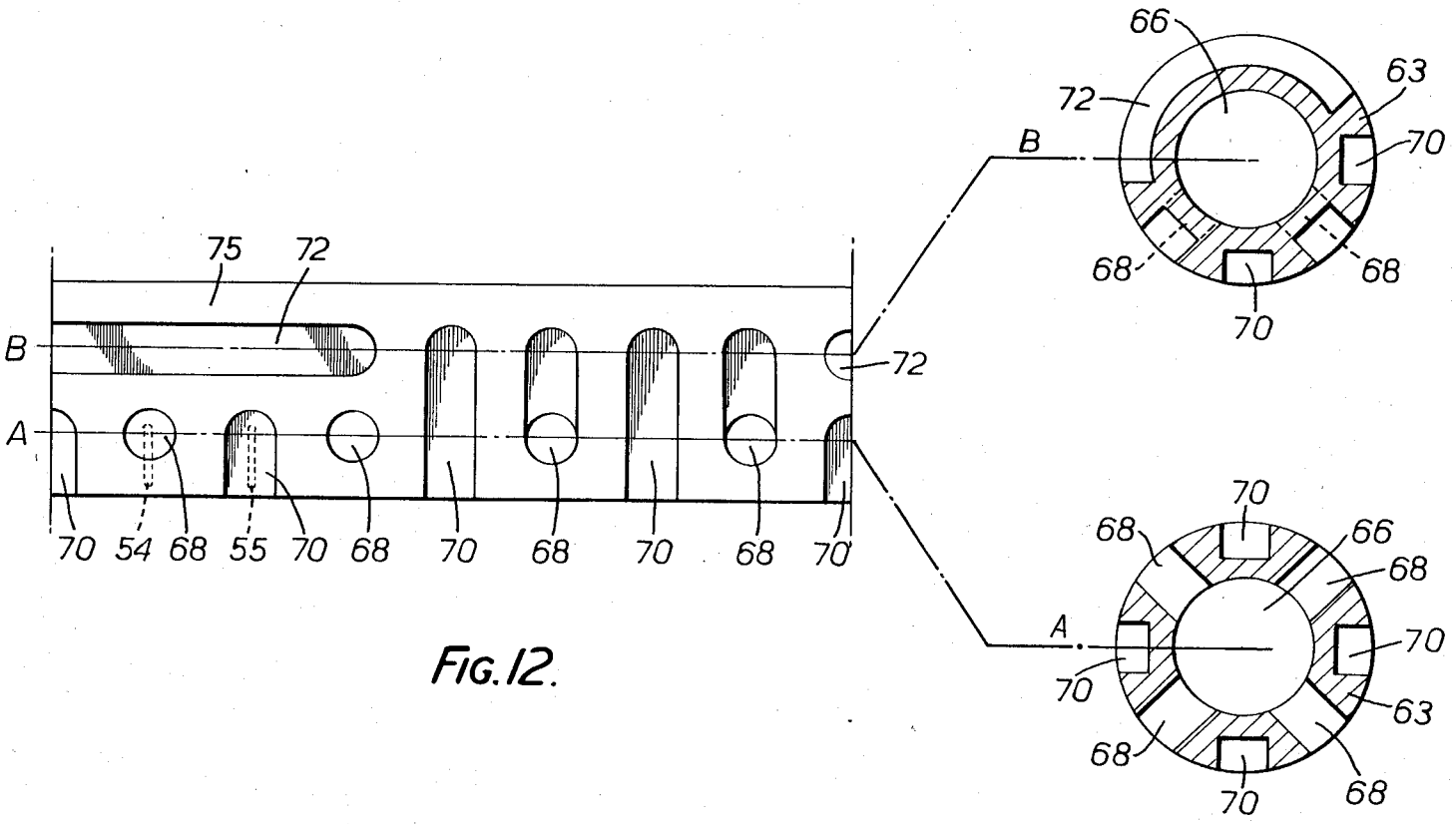
Figure 13:
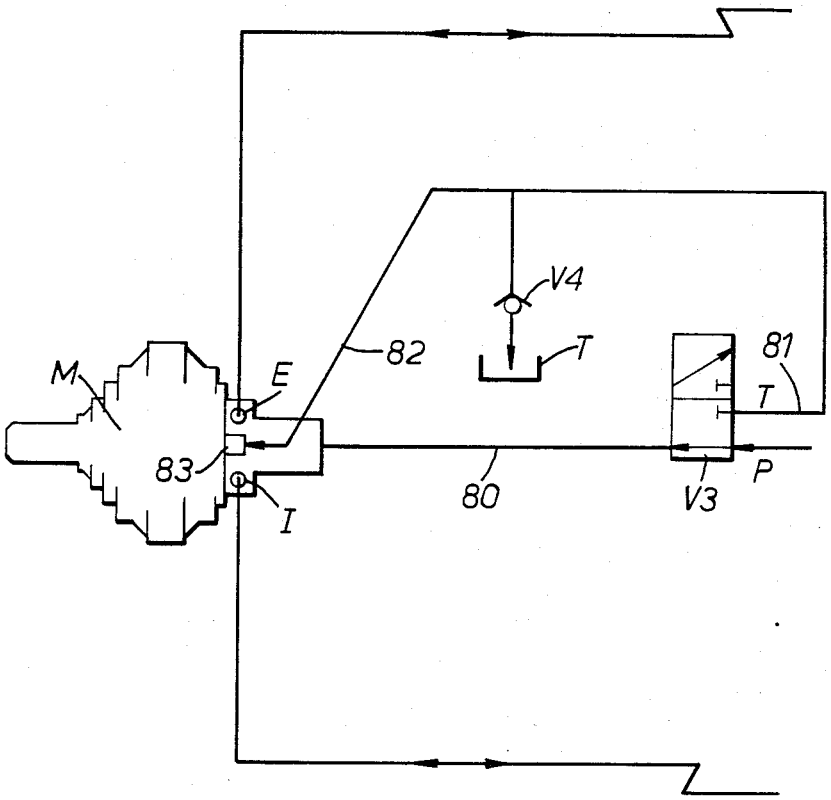
Figure 14:
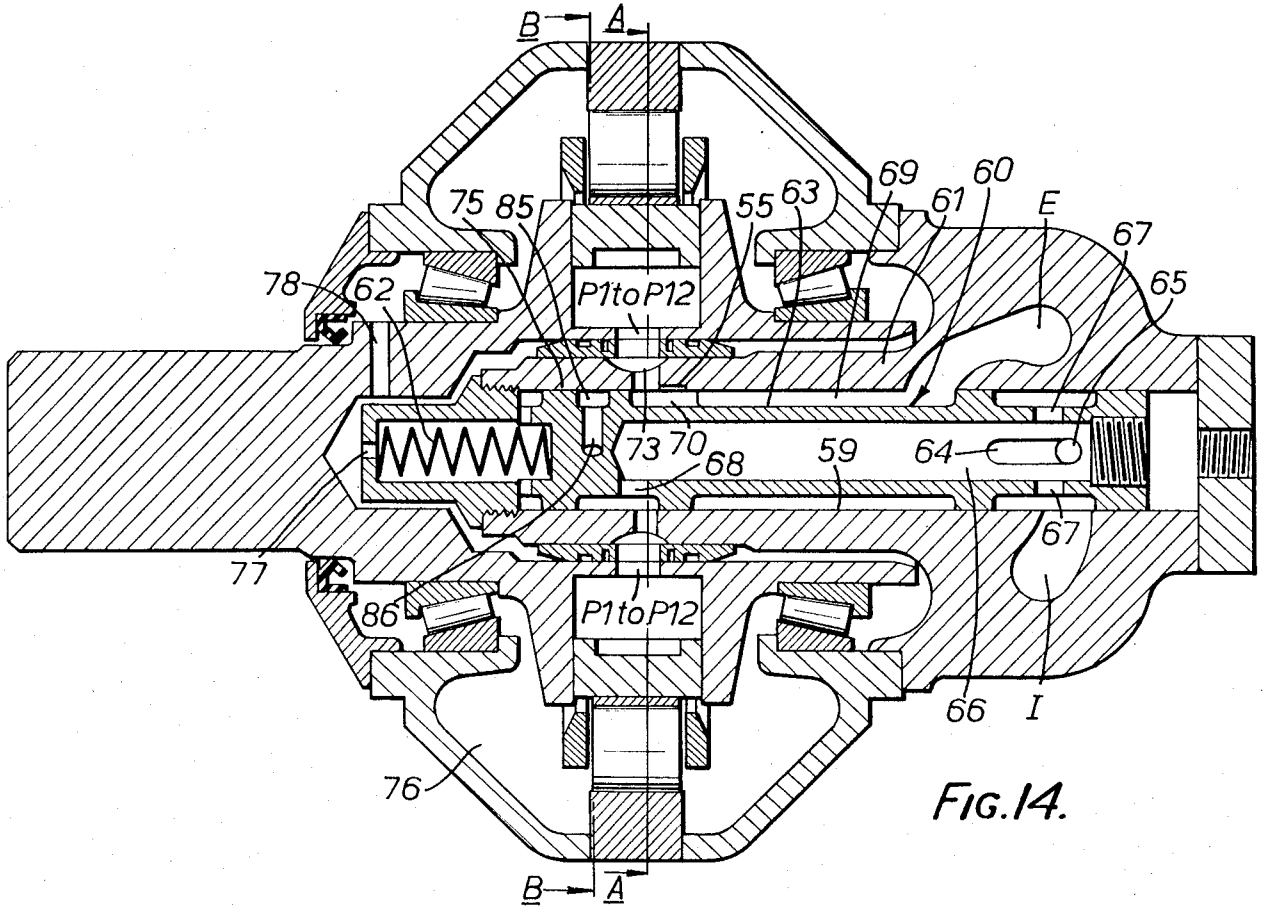
Figure 15:
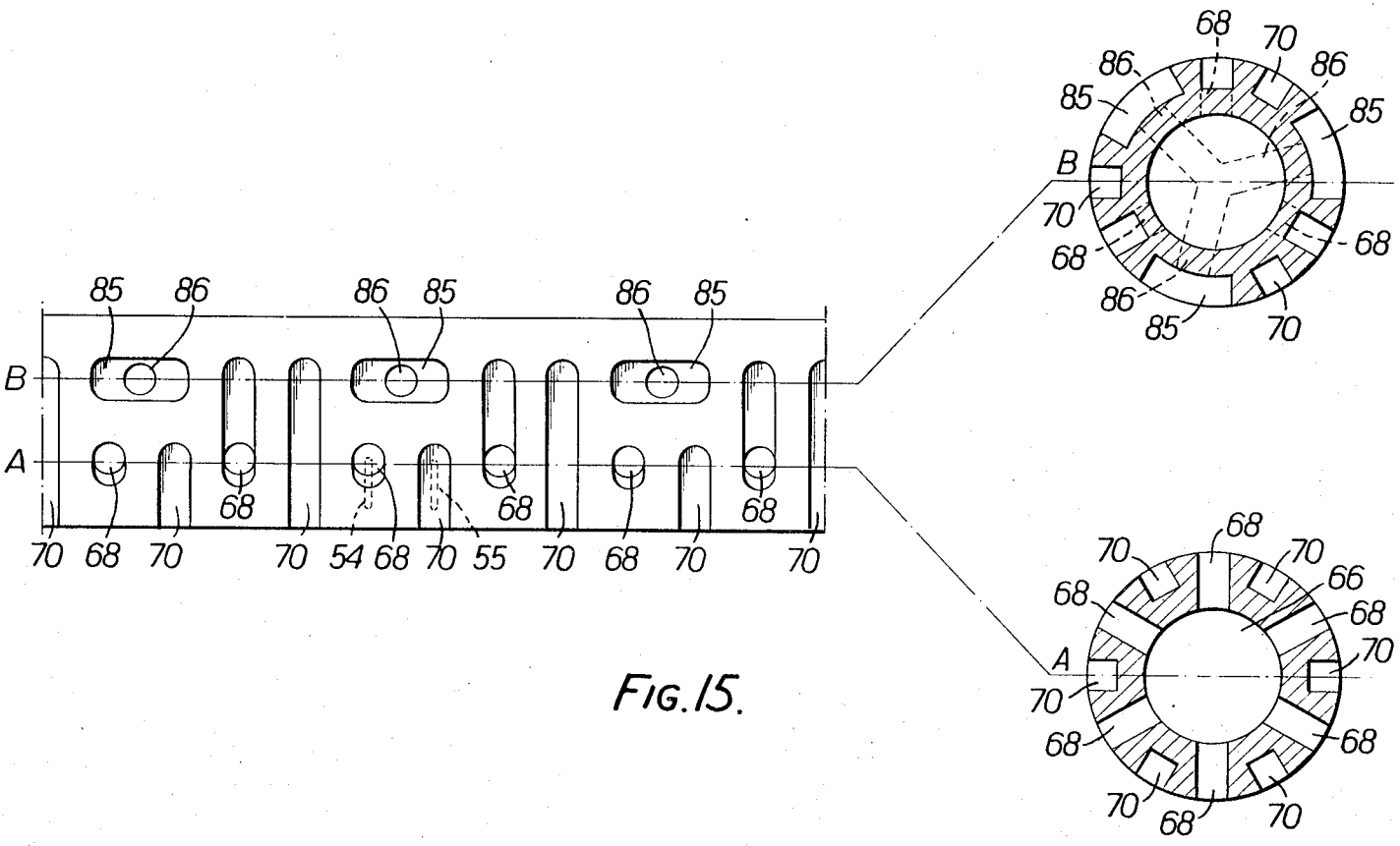
Figure 16:
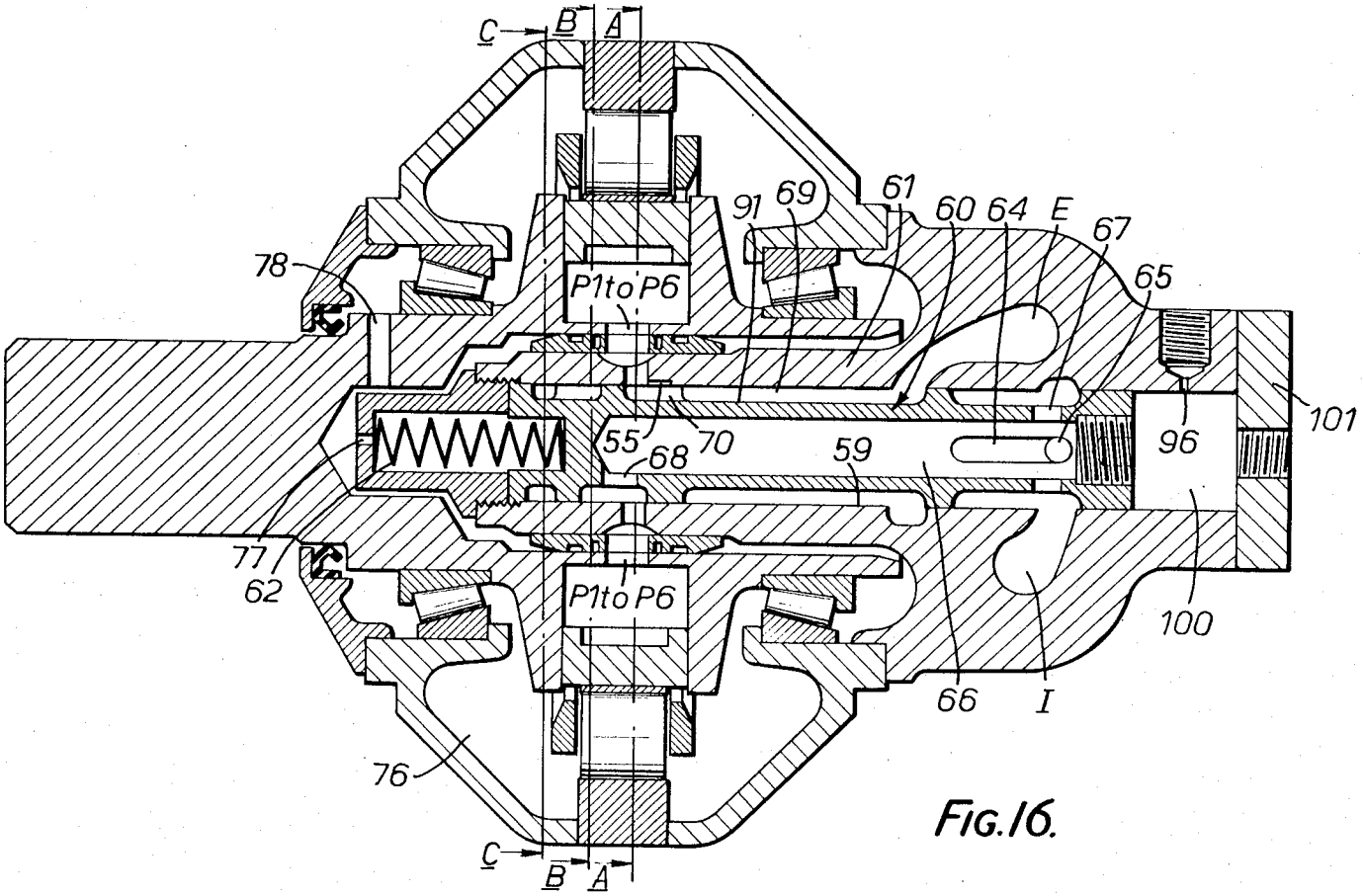
Figure 17:
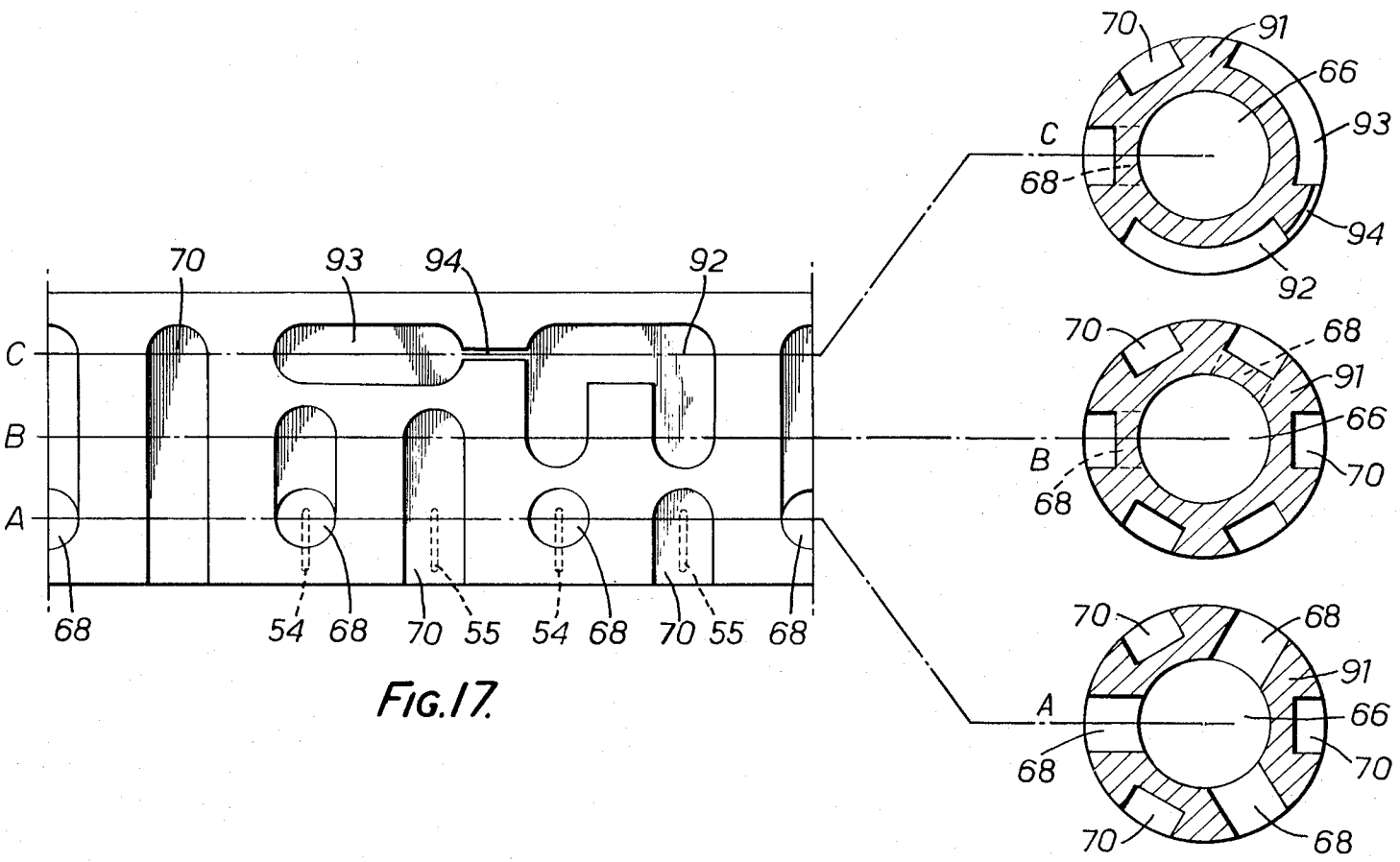
Figure 18:
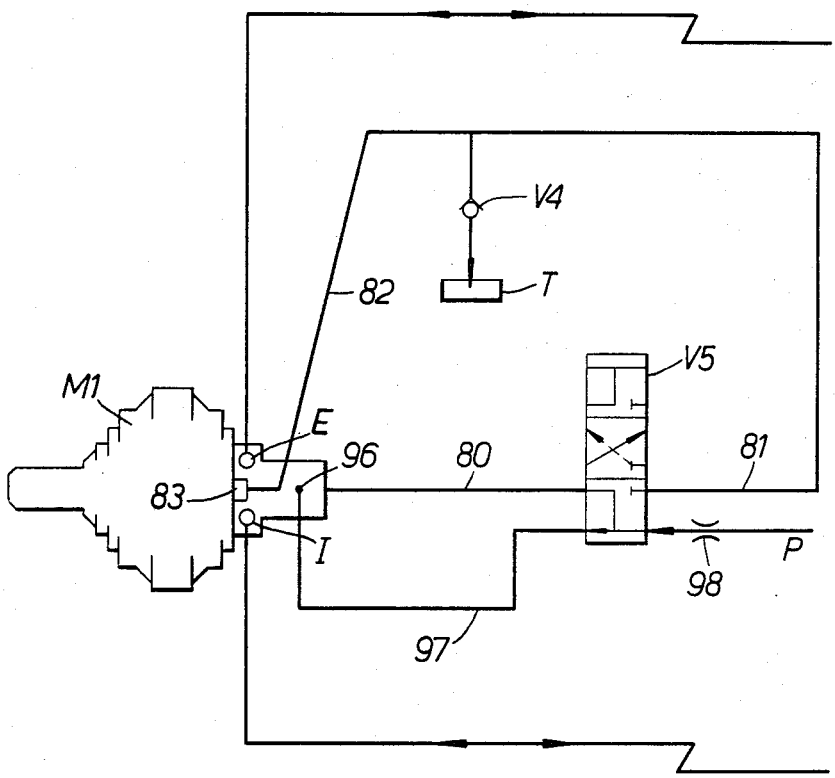
Figure 19:
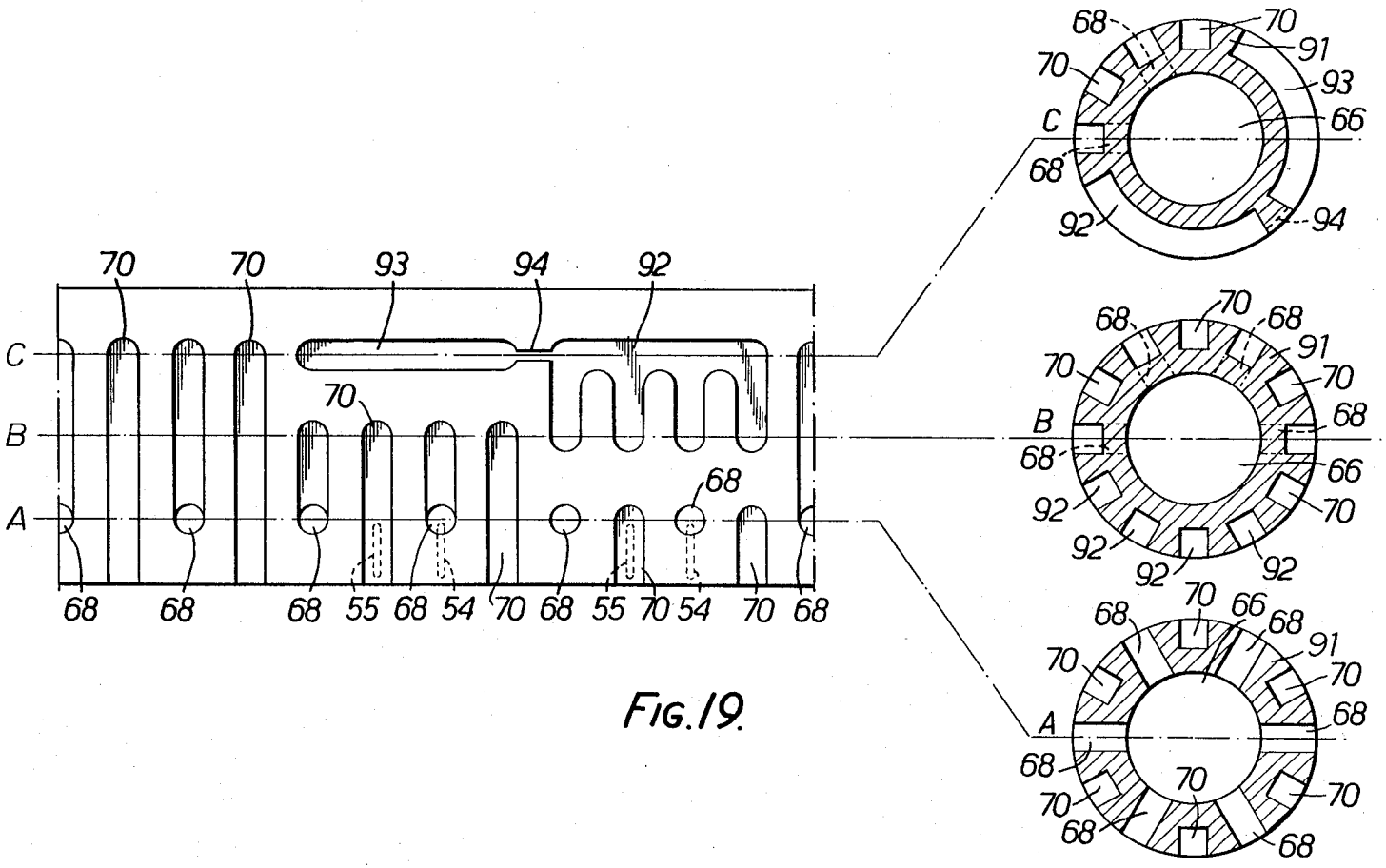
Figure 20:
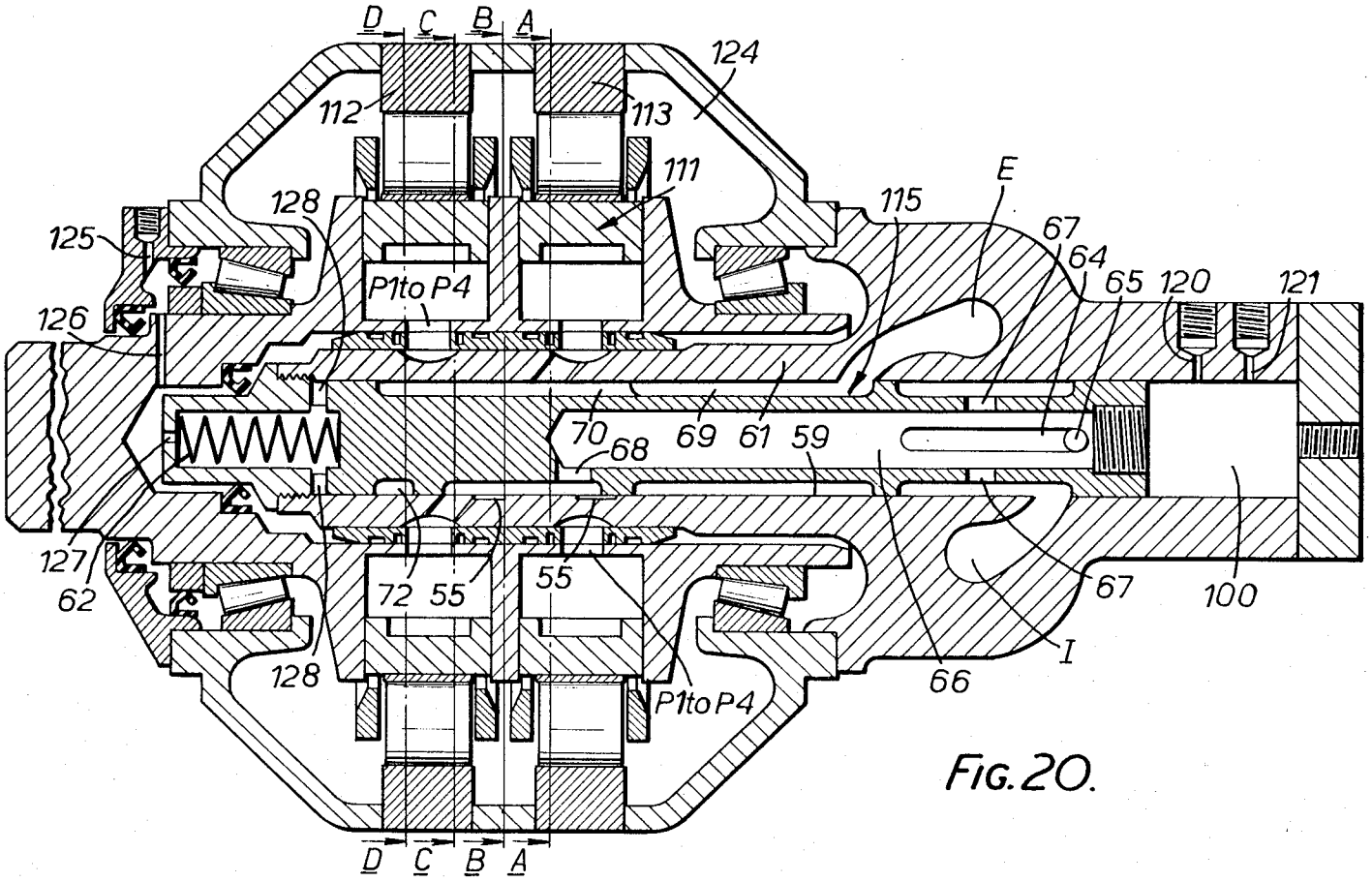
Figure 21:
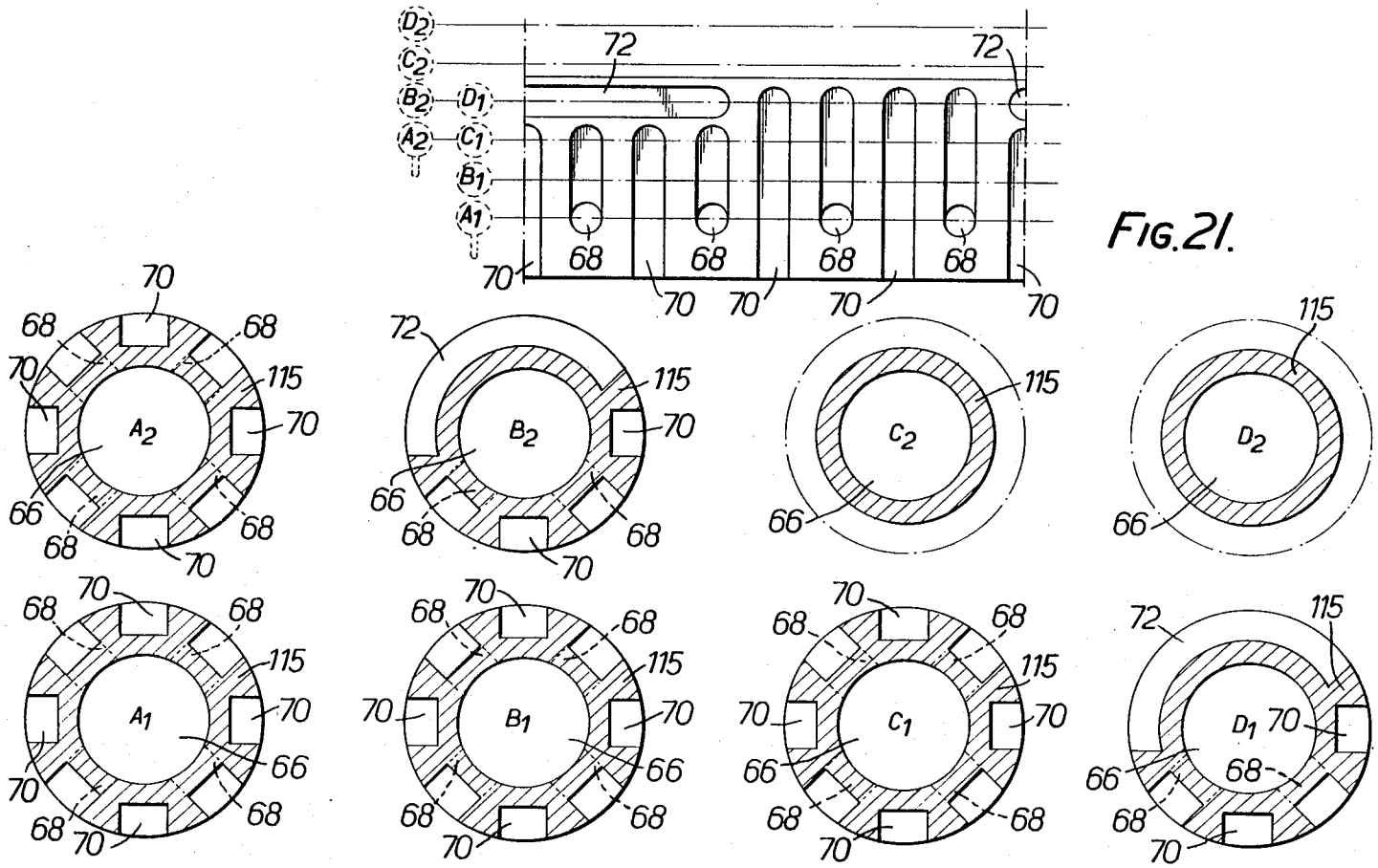
Figure 22:
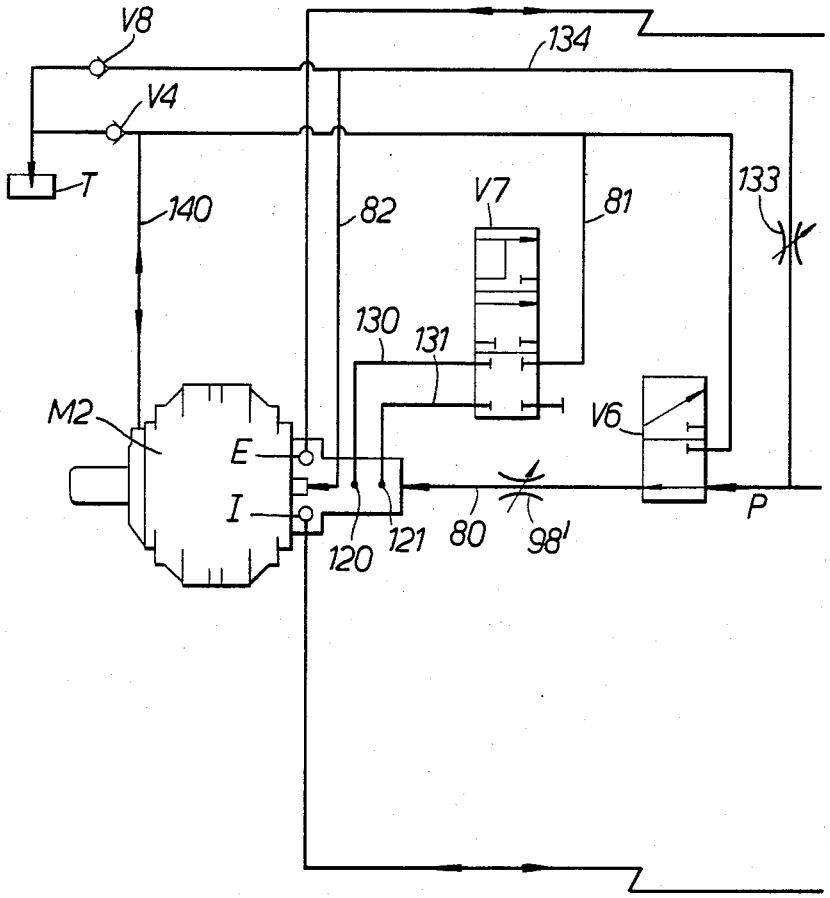
Figure 23:
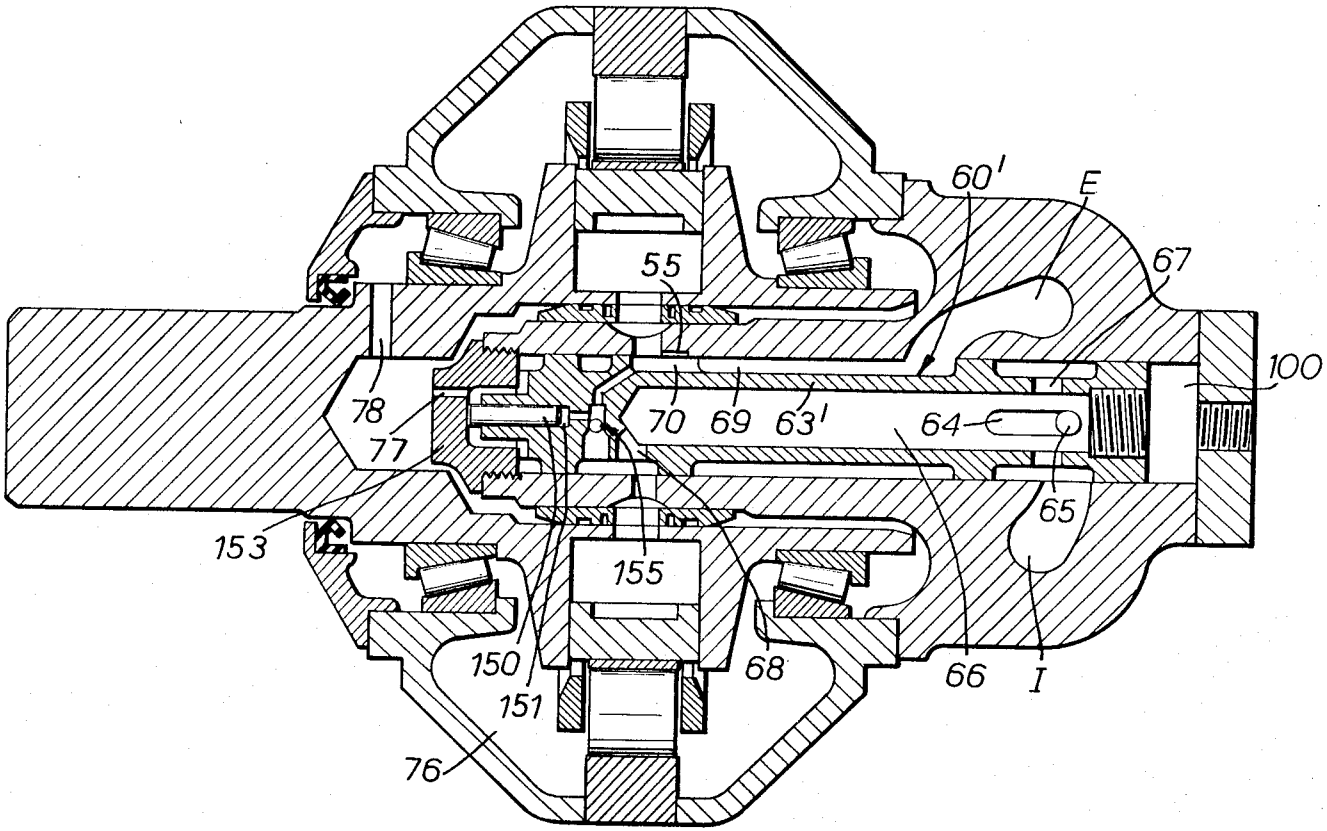
Figure 24:
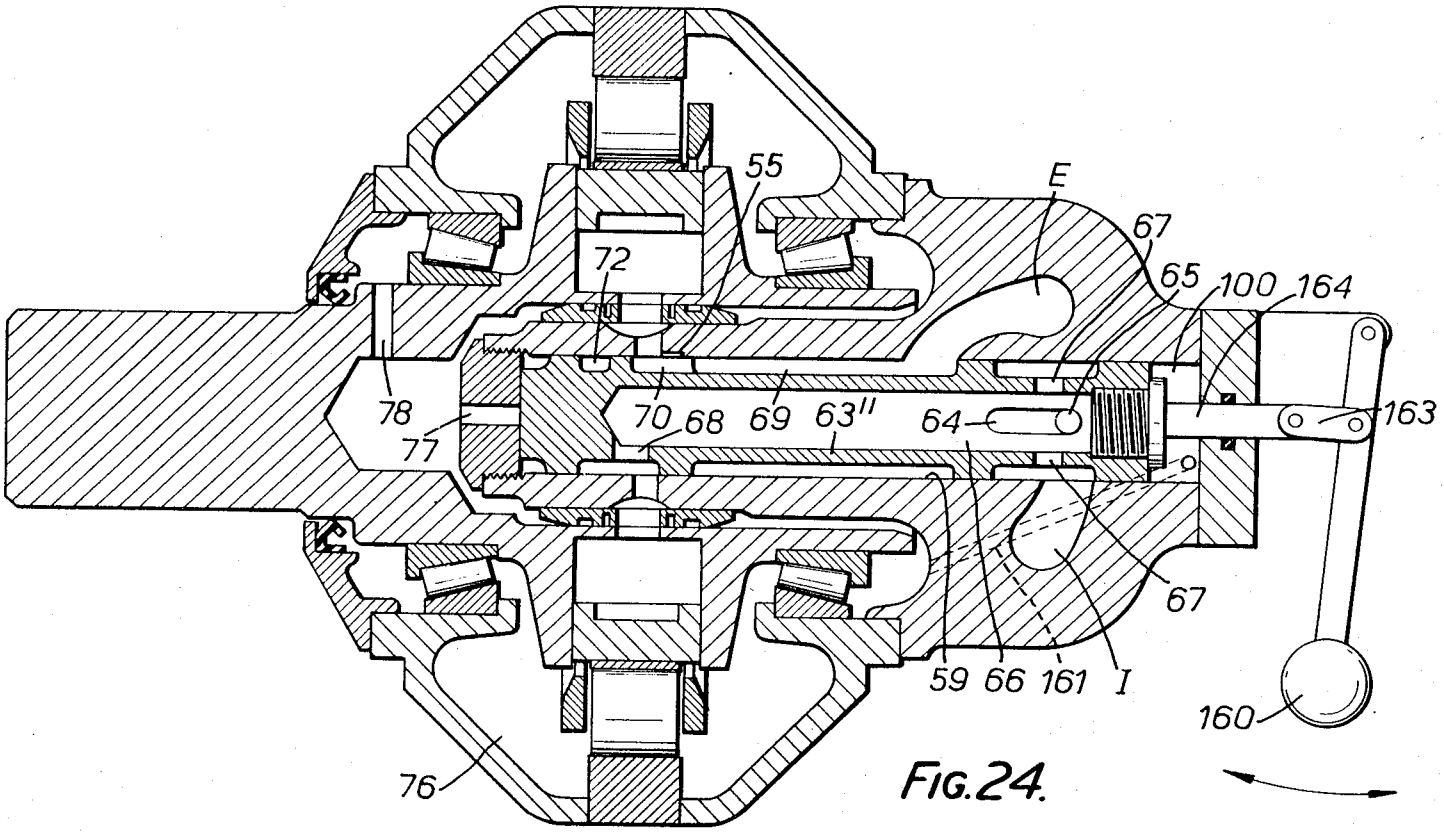

FIG. 12 combines cross-sectional views on planes A—A and B—B in FIG. 11 respectively of the valve spool of the valve means with a development showing a part of the circumferential surface of the valve spool and the fluid flow holes and grooves therein;

FIG. 13 is a diagram of an hydraulic fluid circuit for the control of the motor of FIGS. 11 and 12;

FIG. 14 is a cross-section through a further complete, two speed, hydraulic motor assembly of the present invention having eight pistons and cylinders and six cam lobes and showing a valve spool of the valve means in a full capacity flow setting;

FIG. 15 combines cross-sectional views on planes A—A and B—B in FIG. 14 respectively of the valve spool of the valve means with a development showing a part of the circumferential surface of the valve spool and the fluid flow holes and grooves therein;

FIG. 16 is a cross-section through a further complete, two speed, hydraulic motor assembly of the present invention, having nine pistons and cylinders and three cam lobes and showing a valve spool of the valve means in a full capacity flow setting;

FIG. 17 combines cross-sectional views on planes A—A, B—B and C—C in FIG. 16 respectively of the valve spool of the valve means with a development showing a part of the circumferential surface of the valve spool of the valve means and the fluid flow holes and grooves therein;

FIG. 18 is a diagram of an hydraulic fluid circuit for the control of the motor of FIGS. 16 and 17;

FIG. 19 corresponds with FIG. 17 and shows the arrangement of fluid flow holes and grooves in the valve spool for a motor assembly as shown in FIG. 16 having nine pistons and cylinders and six cam lobes;

FIG. 20 is a cross-section through a complete, four speed hydraulic motor assembly of the present invention having twelve pistons and cylinders arranged in two rows of pistons and cylinders, and a pair of cams each having four cam lobes and showing a valve spool of the valve means in a full capacity flow setting;

FIG. 21 combines cross-sectional views on planes A—A, B—B, C—C and D—D in FIG. 20 respectively of the valve spool of the valve means for two valve spool positions $A_1$ $A_2$, $B_1$ $B_2$, $C_1$ $C_2$, and $D_1$ $D_2$ in each plane with a development showing a part of the circumferential surface of the valve spool and the fluid flow holes and grooves therein;

FIG. 22 is a diagram of an hydraulic fluid circuit for the control of the motor shown in FIGS. 20 and 21;

FIG. 23 is a cross-section of a further complete, two speed, hydraulic motor assembly of the present invention; and FIG. 24 is a cross-section of a still further complete, two speed, hydraulic motor assembly of the present invention.

Figure 1:
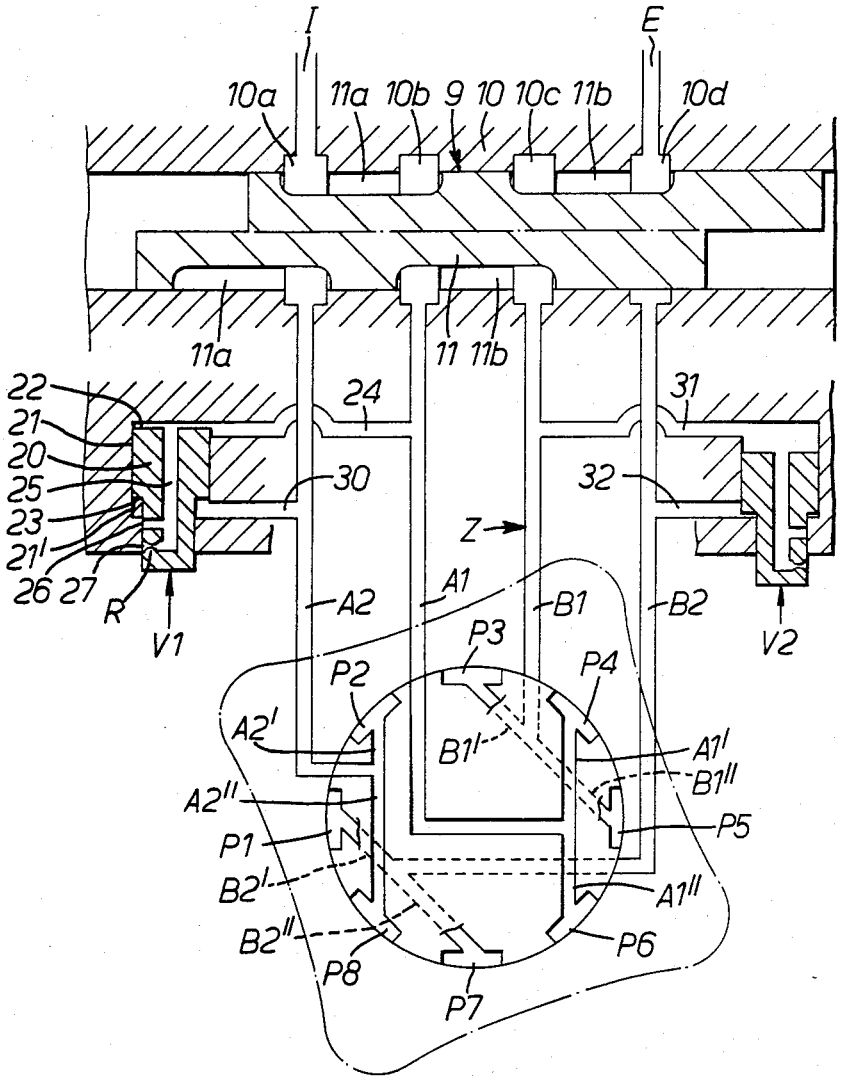
FIG. 1 is a diagrammatic illustration of an hydraulic machine according to the present invention, showing the valve means in alternative positions.
Figure 1A:
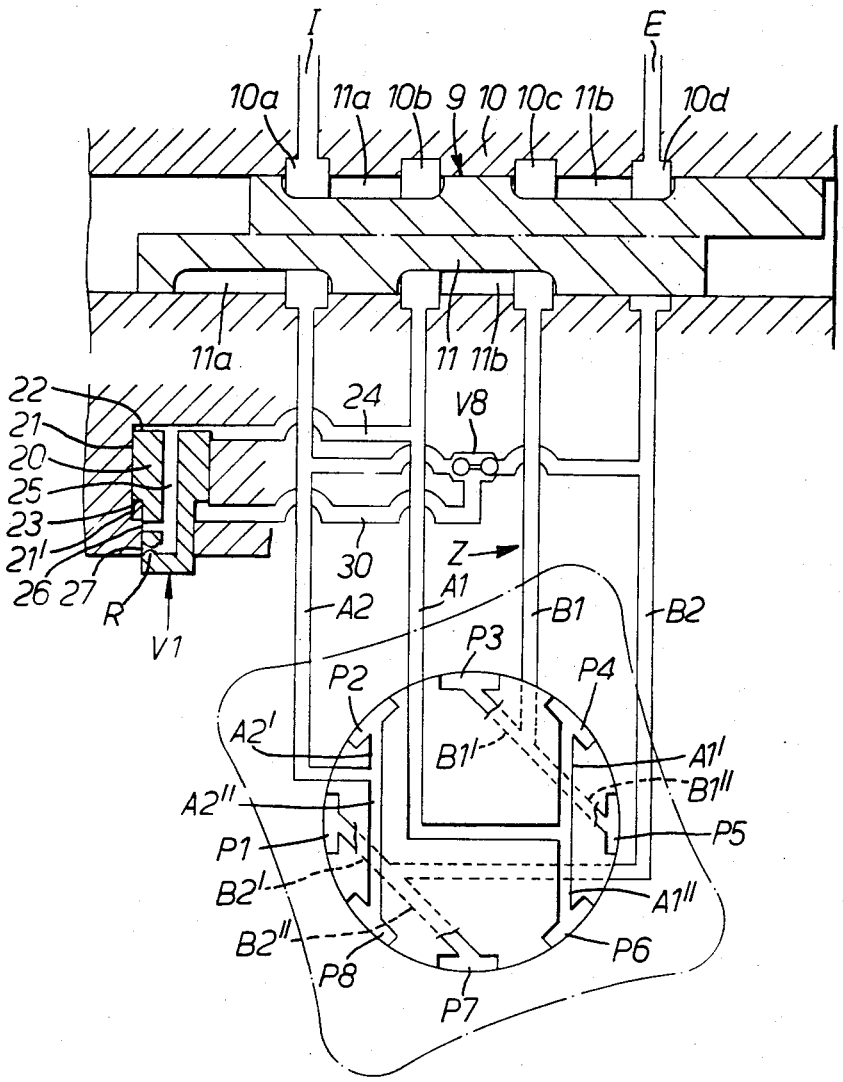
FIG. 1A is a diagrammatic illustration corresponding with FIG. 1 and showing a modification.
Figure 2:
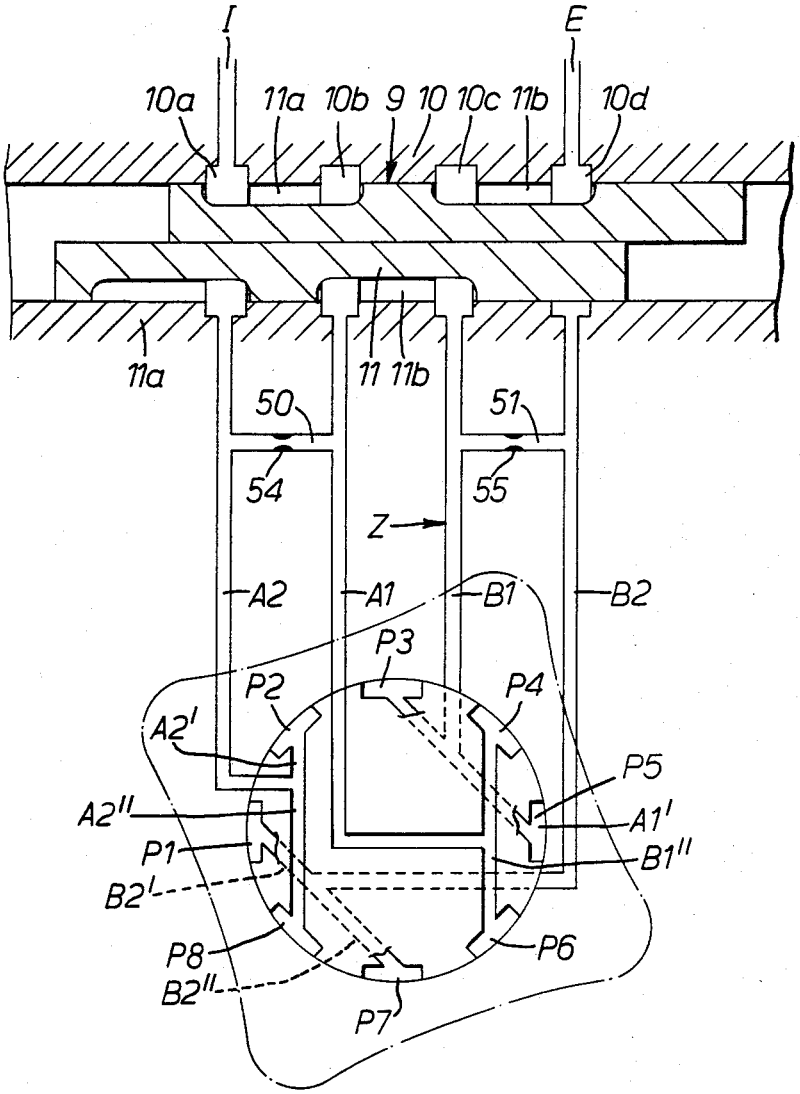
FIG. 2 is a diagrammatic illustration corresponding with FIGS. 1 and 1A, showing a further embodiment of an hydraulic machine according to the present invention.

With reference to FIGS 1, 1A and 2, the hydraulic machines there illustrated may be constructed generally as described in British Patent Specification No. 1,413,107. Thus, the machines may be of compact, relatively lightweight design comprising a rotor (not shown) having just six radial pistons and cylinders, the pistons carrying roller followers running in engagement with a four lobe cam indicated in broken line outline in FIGS. 1, 1A and 2, and each traversing each cam lobe during a full rotation of the rotor. The arrangement is such that the contact stress between the cam track and the rollers is minimized, such that the sum of the velocities of all the pistons remains constant when the rotor rotates at constant speed so that when a constant flow of fluid is supplied to the machine at constant pressure the machine is driven as a motor to produce a constant torque output at its motor shaft. In the same way, if the machine is driven at its shaft as a pump, with a constant torque, it produces a constant flow of fluid at a constant pressure. Furthermore, the cam lobes are all of identical shape and size, the cam has a symmetrical form and the pistons and cylinders are all identically proportioned and symmetrically arranged such that the vector sum of the forces acting on the pistons due to the fluid pressure is balanced in all positions of rotation of the rotor during a full rotation of the machine.

The machine rotor is mounted to rotate on a pintle presenting a ring of eight ports P1 to P8 in FIGS. 1 and 2. The ports P1 to P8 are alternatively in communication with the pressure fluid inlet I and the exhaust fluid outlet E of the machine for low speed, high torque operation of the machine as a motor, and the machine is reversible upon reversal of the fluid inlet and exhaust outlet connections to the machine, conveniently by means of a reversing valve (not shown). The inlet ports P2, P4, P6 and P8 are supplied with pressure fluid from the pressure fluid inlet I via circumferential grooves 10*a* and 10*b* and a circumferential groove 11*a* respectively in a casing 10 of a control valve 9 and a control valve spool 11 slidable axially in the casing 10, through passages A1 and A2 and their branch passages A1′, A1″ and A2′, A2″ in the pintle. The control valve 9 also communicates the exhaust ports P1, P3, P5 and P7 with the exhaust fluid outlet via passages B1 and B2 and their branch passages B1′, B1″ and B2′, B2″ in the pintle, circumferential grooves 10*c* and 10*d* in the casing 10 and a circumferential groove 11*b* in the spool 11 when the control valve 9 is in its low speed, high torque position in which its spool 11 is displaced to the right in FIGS. 1, 1A and 2.

When it is desired to operate the machine as a motor having a high speed, reduced torque output, the control valve spool 11 is displaced to the left hand position shown in FIGS. 1, 1A and 2 in which the groove 11*b* isolates the ports P3, P4, P5 and P6 from the fluid pressure inlet I and the exhaust fluid outlet E and communicates these ports with one another via the casing grooves 10*b* and 10*c* and the passages A1, B1 and their branch passages A1′, A1″ and B1′, B1″ respectively in an isolated zone Z of the machine. At the same time, the grooves 10*a* and 11*a* and the passages A2, A2′, A2″ communicate the ports P2 and P8 with the fluid pressure inlet I and the groove 10*d* and the passages B2, B2′, B2″ communicate the ports P1 and P7 with the exhaust fluid outlet E.

A pair of identical differential control valves V1 and V2 (FIG. 1) are provided to control the pressure of fluid in the zone Z, one for each direction of rotation of the machine. Each valve V1, V2 has an axially slidable, stepped cylindrical spool 20 confined in a stepped cylindrical bore 21 of the machine casing to present an end face 22 in the blind end of the bore. The bore 21 opens to the interior of the machine casing at its other end in a region of the casing exposed to atmospheric pressure. The end face 22 is opposed by an annular face 23 of the spool, of one half the area of the face 22, the annular face 23 being exposed in the bore 21 at an intermediate portion 21′ thereof, the open end of the bore being closed by the spool. The spool has an axial passage 25 opening at one end in its end face 22 and, via transverse branch passages, at two axially spaced ports 26 and 27 in its cylindrical surface on the side of its face 23 remote from its face 22. The branch passage communicating the passage 25 with the port 27 contains a restricter R to restrict the flow of fluid through the port 27 when this port is uncovered by the bore 21.

In the case of the valve V1, a branch passage 24 connects the passage A1 with the blind end of its bore 21 and a branch passage 30 connects the intermediate portion 21′ of its bore with the passage A2.

Corresponding connections are made for the valve V2 (FIG. 1) by branch passages 31 and 32, with the passages B1 and B2 respectively.

When working fluid at inlet pressure is supplied to the passage A2, the differential control valve V1 is displaced upwardly in FIG. 1 by the high pressure fluid acting on the face 23 of its spool 20 and the ports 26 and 27 are covered by the bore 21 in a balanced condition of the spool in which the pressure in the zone Z and acting on the face 22 of the spool is equal to one half the difference between the inlet pressure and atmospheric pressure. If the pressure in the zone Z falls below this value for any reasons, the spool 20 is displaced upwardly by the pressure of fluid acting on its face 23 and fluid at the inlet pressure enters the zone Z via the port 26 which is uncovered in the intermediate portion 21′ of the bore 21 to admit fluid from the bore 21 to the passage 25 and into the zone Z to increase the pressure of fluid in the zone Z. The differential control valve V2 is maintained in its lowermost position in FIG. 1 by the intermediate pressure of fluid in the zone Z and acting on the face 22 of its spool 20 and a restricted leakage of fluid from the zone Z occurs, into the machine casing at atmospheric pressure through the restricter R of the valve V2.

The system is protected against over pressurization of the zone Z by leakage of fluid through the restricter R of the valve V2 and ultimately through the restricter R of the valve V1 if the pressure in the zone Z should rise above the inlet pressure for any reason.

Leakage of pressure fluid from the zone Z through the restrictor R of the valve V2 is made up from the fluid at inlet pressure in the port P2 and from the intermediate zone 21′ of the bore 21 during operation of the machine.

Upon reversal of the machine the valves V1 and V2 reverse their functions as described.

The valve V2 may be dispensed with and the passage 30 connected alternatively with the passage B2 for reverse operation of the machine via a change-over valve V8 (FIG. 1A) operated by the inlet fluid pressure.

The spool 20 is maintained in a balanced condition so long as the pressure of fluid in the intermediate pressure zone Z is maintained at the desired intermediate pressure for either direction of rotation. If the pressure in the zone Z falls below the desired intermediate pressure for any reason, the spool 20 is displaced upwardly by the pressure of fluid acting on its face 23 and fluid at the inlet pressure enters the zone Z from the port 26 as before. If the pressure in the zone Z rises, the spool 20 is displaced downwardly in FIGS. 1 and 1A and a restricted leakage of fluid from the zone Z occurs into the machine casing at atmospheric pressure through the restrictor R until such time as the desired intermediate pressure determined by the relative areas of the faces 22 and 23 of the spool 20 is again achieved.

During each full rotation of the machine in its high speed, low torque phase, the pistons and cylinders passing the high pressure ports P2 and P8 receive high pressure fluid from the inlet I. Each piston and cylinder passing the high pressure port P8, having performed a working outstroke of its piston, discharges working fluid directly to the exhaust fluid outlet E through the discharge port P1. Each piston and cylinder passing the high pressure port P2, having performed a working outstroke of its piston, discharges working fluid to the exhaust fluid outlet E via the zone Z through the discharge port P3, at the intermediate pressure, each piston and cylinder passing the port P6 of the zone Z receiving an equivalent volume of fluid at the intermediate pressure and performing a working outstroke of its piston and discharging the same volume of fluid to the exhaust fluid outlet E as it passes the discharge port P7. Each piston and cylinder passing the intermediate pressure port P4 receives fluid at the intermediate pressure and performs a working outstroke of its piston, and discharges the same volume of fluid back to the zone Z at the same intermediate pressure as it passes the discharge port P5.

The net torque on the rotor produced by the pistons and cylinders passing the intermediate pressure ports P3 to P6 is zero since the torque produced on the outstrokes of the pistons operated upon by fluid at the intermediate pressure entering the cylinders through the ports P4 and P6 is consumed on the instrokes of the pistons discharging fluid through the discharge ports P3 and P5 at the same intermediate pressure. The torque output of the motor is thus reduced. However, the capacity of the motor to receive and discharge a given flow of working fluid to the inlet I is reduced by approximately one half and the speed of the motor is accordingly substantially increased.

The embodiment of FIG. 2 differs from that of FIG. 1 only in as far as the differential control valves V1, V2 are replaced by passages 50, 51 interconneconecting the passages A1 and A2, and B1 and B2, respectively. The passages 50, 51 contain nominally equal restricters 54, 55 to limit the flow of fluid through the passages 50 and 51 from the high pressure region in the passage A2 in communication with the fluid pressure inlet I to the intermediate pressure region of the zone Z in the passage A1, and from the intermediate pressure region of the zone Z in the passage B1 to the exhaust pressure region in the passage B2 in communication with the exhaust outlet E.

With this arrangement, the pressure in the intermediate pressure zone Z is balanced by the flow of fluid through the restricters 54, 55 at one half the difference between the inlet fluid pressure supplied to the inlet I and the pressure of fluid at the exhaust fluid outlet E and the same conditions apply when the machine is reversed.

Figure 3:
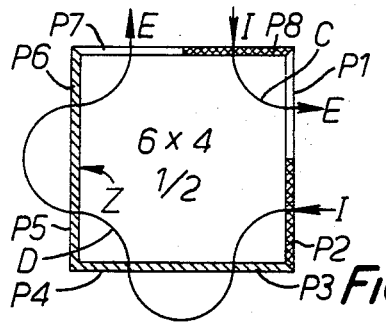
FIG. 3 is a diagram corresponding with FIGS. 1 and 2 and further illustrating the operation of the machines of FIGS. 1 and 2 as motors in a high speed, reduced torque phase.

FIG. 3 is a diagram corresponding with FIGS. 1 and 2 and further illustrating the operation of the motors of FIGS. 1 and 2 in the high speed, reduced torque phase. Each side of the square in the diagram represents one of the four cam lobes of the motor and an adjacent pair of the ports P1 to P8. The plain (i.e. un-hatched) side sections P1 and P7 indicate these ports as being, for the time being, exposed to the exhaust fluid pressure in the exhaust fluid outlet E. The double cross-hatched sections P2 and P8 indicate these ports exposed to inlet pressure in the high pressure fluid inlet I. The single cross-hatched sections P3 to P6 inclusive indicate these ports as being isolated in the intermediate pressure zone Z. This same convention for indicating ports exposed to inlet pressure, exhaust pressure and intermediate pressure in the intermediate pressure zone Z is used throughout the ensuing diagrammatic FIGS. 4 to 10 yet to be described. The two arrows C and D illustrate respectively, the flow of working fluid directly in the main hydraulic circuit between the high pressure fluid inlet I and the exhaust fluid outlet E via ports P8 and P1, and the flow of working fluid indirectly from and to the main hydraulic circuit between the high pressure fluid inlet I and the exhaust fluid outlet E via the ports P2, P3, P4, P5, P6 and P7 as already described. Arrow D indicates the ports P2 and P7 interconnected by a working fluid loop including a temporary by-pass loop between the ports P3 and P7, the temporary by-pass loop by-passing the inoperative cylinders of the motor in the high speed, reduced torque phase.

It is the characteristic of an hydraulic motor of the present invention that working fluid is continuously exchanged between the main hydraulic circuit and such a temporary by-pass loop in a higher speed, reduced torque phase of operation of the motor. The temporary by-pass loop constitutes the zone Z of the machine and is so marked in FIG. 3. By regulating the by-pass loop pressure to a predetermined proportion of the inlet pressure in the manner explained with reference to FIGS. 1, 1A and 2, the non-operative pistons are enjoined to assist in relieving the out of balance forces. In the particular embodiments described having six pistons and cylinders and four cam lobes and assuming that the cam lobes provide for piston acceleration during the first 15° of angular stroke duration of each stroke, constant piston velocity during the next 15° of angular stroke duration of each stroke and piston deceleration during the final 15° of angular stroke duration of each stroke, by controlling the by-pass loop pressure to 50% of the working fluid inlet pressure, it may be shown that, theoretically, the out of balance force acting on the rotor is one piston's worth of force acting for 50% of the time. In an equivalent prior art closed system as described in British Patent Specification No. 1,063,673 on the other hand, it may be shown that the theoretical out of balance force which occurs ranges between 1.000 and 1.732 times one piston's worth of force for 100% of the time. This is impractical in a compact motor having only six pistons and cylinders and four cam lobes.

In the high torque low speed phase of the motors illustrated in FIGS. 1, 1A and 2 the fluid flow pattern in FIG. 3 would be illustrated by four arrows C, one at each corner. The capacity of the rotor to receive working fluid is then $4\times6$ cylinder's worth of fluid per revolution of the rotor, as illustrated by the four arrows C. With the fluid flow pattern actually illustrated in FIG. 3, the capacity of the motor to receive working fluid is reduced to $2\times6$ cylinder's worth of fluid per revolution of the rotor as illustrated by the two arrows C and D. The speed of the motor is therefore approximately doubled for the same supply of working fluid to the rotor.

Figure 4:
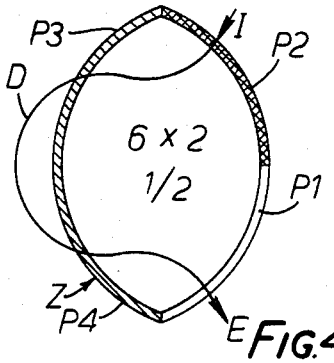
FIG. 4 is a diagram corresponding with FIG. 3 showing the fluid interconnection arrangements for an hydraulic piston and cylinder machine of the present invention having six pistons and cylinders and two cam lobes.

FIG. 4 is a diagram corresponding with FIG. 3 and showing the fluid interconnection arrangements for an hydraulic piston and cylinder machine having six pistons and cylinders and two cam lobes in a high speed, low torque setting of the control valve corresponding with the valve 9 in FIGS. 1, 1A and 2. In this case, the machine rotor is mounted to rotate on a pintle presenting a ring of four ports P1 to P4. Inlet port P2 is connected with the high pressure inlet I, the ports P3 and P4 are connected with the isolated intermediate pressure zone Z and the port P1 is connected with the exhaust fluid outlet E. No direct flow of working fluid corresponding to arrow C of FIG. 3 occurs in this case. There is but a single indirect flow again indicated by the arrow D. Instead of 2×6 cylinder's worth of fluid per revolution of the rotor, the motor receives 1×6 cylinder's worth of fluid and the speed of the motor is again approximately doubled in this phase.

Figure 5:
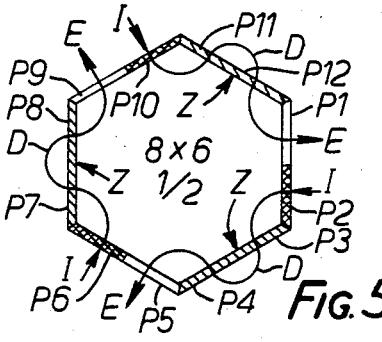
FIG. 5 is a diagram corresponding with FIG. 3 showing fluid interconnection arrangements for an hydraulic piston and cylinder machine of the present invention having eight pistons and cylinders and six cam lobes.

FIG. 5 is a diagram corresponding with FIG. 3 and showing interconnection arrangements for an hydraulic piston and cylinder machine having eight pistons and cylinders and six cam lobes in a high speed, low torque setting of the control valve corresponding with the control valve 9 in FIGS. 1, 1A and 2. The inlet ports P2, P6 and P10 are connected with the high pressure inlet I, the ports P3, P4, P7, P8, P11 and P12 are connected with the isolated, intermediate pressure zone Z and the ports P1 and P5 are connected with the exhaust fluid outlet E. The flow capacity of the motor is again halved.

Figure 6:
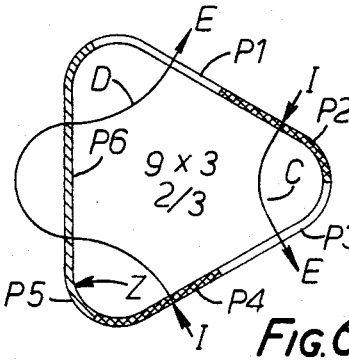
FIGS. 6 and 7 are diagrams corresponding with FIG. 3 and showing alternative fluid interconnection arrangements for an hydraulic piston and cylinder machine of the present invention having nine pistons and cylinders and three cam lobes.
Figure 7:
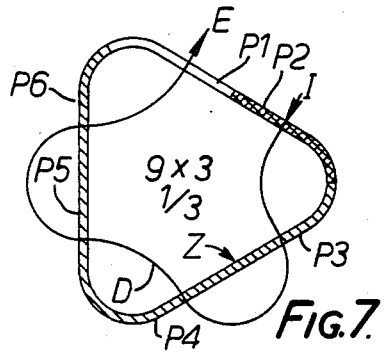

FIGS. 6 and 7 are diagrams corresponding with FIG. 3 and showing alternative fluid interconnection arrangements for an hydraulic piston and cylinder machine having nine pistons and cylinders and three cam lobes in a high speed, low torque setting of a three position control valve corresponding with the control valve 9 in FIGS. 1, 1A and 2.

In FIG. 6 the ports P2 and P4 are connected with the high pressure inlet I, the ports P5 and P6 are connected with the isolated, intermediate pressure zone Z and the ports P1 and P3 are connected with the exhaust fluid outlet E.

This arrangement corresponds with that of FIG. 3 to the extent that direct flow of working fluid occurs via two of the ports, in this case ports P2 and P3, as indicated by arrow C, and indirect flow of working fluid occurs in a loop including a temporary by-pass loop as indicated by the arrow D. Instead of 3×9 cylinder's worth of fluid per revolution of the rotor, the motor receives 2×9 cylinder's worth of fluid and the flow capacity of the motor is reduced to two thirds and the speed of the motor increased accordingly.

In FIG. 7 the port P2 is connected by means of a fluid control valve setting with the high pressure inlet I, the ports P3, P4, P5 and P6 are connected with the isolated, intermediate pressure zone Z and the port P1 is connected with the exhaust fluid outlet E. The capacity of the motor to receive working fluid is reduced from 3×9 to 1×9, i.e. by one third and the speed of the motor is increased accordingly.

An hydraulic motor according to the invention, having nine pistons and three cam lobes, therefore, offers the facility of three speeds using a three position valving arrangement to select full, two thirds or one third flow capacity of the motor. Furthermore, the out of balance force at reduced flow capacity is 0.663 of one piston's worth of force compared with 1.000 to 1.879 using a prior art closed system to isolate the inoperative cylinders.

Figure 8:
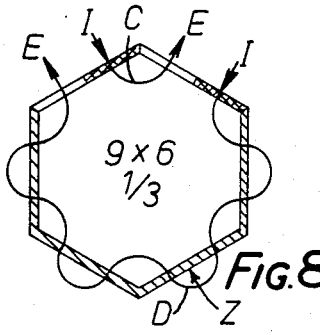
FIGS. 8 and 9 are diagrams corresponding with FIG. 3 and showing alternative fluid interconnection arrangements for an hydraulic piston and cylinder machine of the present invention having nine pistons and cylinders and three cam lobes.
Figure 9:
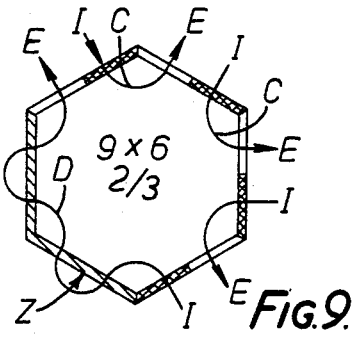

In FIGS. 8 and 9 the machine has a ring of twelve ports, nine pistons and cylinders and six cam lobes and offers three equivalent speed settings, the flow patterns for the increased speed settings being shown in the two figures respectively. The out of balance force at reduced flow capacity is in the range of 0.266 and 0.814 of one piston's worth of force. In the equivalent prior art closed system the out of balance force ranges between 1.000 and 1.879 times one piston's worth of force.

Figure 10:
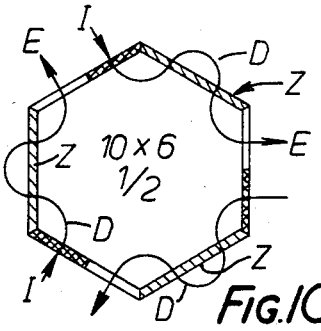
FIG. 10 is a diagram corresponding with FIG. 3 showing the fluid interconnection arrangements for an hydraulic piston and cylinder machine having ten pistons and cylinders and six cam lobes.

FIG. 10 illustrates a machine having a ring of twelve ports, ten pistons and cylinders, six cam lobes and three working fluid loops including temporary by-pass loops in a reduced flow capacity setting of the machine.

Referring now to FIGS. 11 and 12, the hydraulic motor assembly shown in FIG. 11 is generally as described in British Pat. Nos. 1,413,107, and 1,413,108, and will not be further described except in so far as is necessary to point out the features of its construction as a specific embodiment of the present invention. The valve means is a two speed valve mechanism, generally indicated at 60. The mechanism 60 is housed entirely within a bore of the stationary casing pintle 61. A return spring 62 for the valve spool 63 is housed in the forward end of the pintle, constituted for the most part by a cap screwed into the end of a pintle bore 59. In FIG. 11 the valve spool 63 is shown in the full capacity flow setting of the motor and the return spring 62 is fully compressed. The spool 63 has a slot 64 into which fits a location dowel 65 to prevent rotation of the spool, the slot 64 nevertheless allowing the spoool to slide axially between two extreme positions. The spool effectively identifies in each of its extreme axial positions, two hydraulic fluid passageways for fluid at inlet pressure I and at exhaust pressure E respectively, the flow being reversible to reverse the direction of operation of the motor. For the direction of rotation being described, fluid at inlet pressure I enters the valve spool bore 66 through the radial holes 67 and exits the bore 66 through radial holes 68 to charge the cylinders, the return flow of fluid exhausted from the cylinders entering the annular passageway 69 around the outside of the spool 63 through the slots 70, and the cylinder ports P1 to P8 also illustrated diagrammatically in FIGS. 1, 1A and 2 being alternately placed in communication with these hydraulic fluid passageways for operation of the motor at full capacity.

The valve spool 63 is retained in the position shown in FIG. 11 by the presence of pressurized fluid on the right-hand end of the spool opposite to that acted upon by the spring 62 of sufficient level to overcome the spring force. When this fluid pressure is released, the spool moves to the right in FIG. 11 under the action of the spring 62 until it reaches the end of its travel determined by the slot 64 and dowel 65, or other suitable stop means. The alignment of the passageways in the spool 63 then corresponds with that shown on line B—B in FIG. 12 hence effectively causing one half of the cylinders in the motor to communicate with the by-pass groove 72 while travelling round one half of each revolution of the motor so that the capacity of the motor to receive working fluid is halved.

The motor assembly being described has a flow pattern of working fluid as hereinabove described with reference to FIG. 2. The restricters 54, 55 are formed by two small axial grooves, the position of which is illustrated in dotted outline in FIG. 12 and one of which, 55, is physically indicated in FIG. 11 by the reference numeral 55, the grooves 54, 55 being formed in the wall of the pintle bore 69 adjacent to the radial port holes 73 in the pintle for feeding to, and for receiving from, the cylinders the working fluid in the motor. The grooves, 54, 55 may be replaced by drillings in the wall of the pintle bore and opening at opposite ends in the pintle bore and in the wall of the radial port hole 73 respectively.

Since the grooves 54, 55 are positioned clear of the sealing lands on the spool, formed between the grooves and openings in the spool, the grooves 54, 55 have no effect in the full capacity setting of the spool. When the spool moves fully to the right in FIG. 11, the left hand land 75 of the spool is bridged by the grooves 54, 55 to communicate the by-passed intermediate pressure zone with the fluid inlet and exhaust flow passageways 66 and 69 respectively.

The incorporation of restricters in the form of the grooves 54, 55 in the manner shown has the advantage that the restricters are self cleaning during operation of the motor at half capacity and hence, insensitive to silting by contamination.

The spring end of the spool 63 has access to the hydraulic fluid in the motor case cavity 76 via holes 77 and 78. When the spool 63 moves to the left in FIG. 11 it displaces a volume of fluid into the motor case and out of the motor case down the usual case drain line (not shown in FIG. 11). When the spool 63 moves to the right in FIG. 11 it will require an equivalent volume of fluid to flow into the motor case to avoid a suction condition which might otherwise lift a shaft seal and allow air and contamination to be drawn in along the shaft. This is achieved by re-circulating the fluid displaced by the right hand end of the spool in FIG. 11 back to the case.

FIG. 13 illustrates a suggested hydraulic fluid circuit for the motor M of FIGS. 11 and 12. The fluid inlet and exhaust ports at the motor case are indicated at I and E respectively. Fluid at pressure P is supplied into the motor case through a fluid line 80, via a two position valve V3, to the right hand end of the valve spool 63 in FIG. 11, to displace the spool to its full capacity flow position as illustrated, in that Figure, against the action of the spring 62. In its alternative position, the valve V3 communicates the right hand of the valve spool 63 with a return fluid line 81 which communicates with the motor case drain line 82. Displacement of the spool 63 to the left in FIG. 11 under the action of the fluid pressure P displaces fluid into the case drain line 82 to tank T through a non-return valve V4. Displacement of the spool 63 to the right in FIG. 11 under the action of the spring 62 displaces fluid into the return line 81 and into the motor case via the line 82 and the motor case drain 83.

Instead of having six pistons and four cam lobes the motor assembly as described with reference to FIGS. 11, 12 and 13 could have six pistons and two cam lobes.

The hydraulic motor assembly shown in FIG. 14 is again generally as described in British Pat. Nos. 1,413,107 and 1,413,108 and parts corresponding with parts already described with reference to FIGS. 11, 12 and 13 are indicated by corresponding reference numerals and will not be further described.

Referring to FIG. 5, which diagrammatically illustrates fluid flow paths for the present motor configuration of eight pistons and cylinders and six cam lobes, it is first to be noted that instead of adjacent cam lobes to be isolated in the intermediate pressure zone Z in the high speed, reduced torque phase of the motor, as shown in FIGS. 3 and 4, it is required, in this case, that alternate cam lobes be isolated in this zone. The consequence is that a different pattern of holes and grooves is required in the valve spool 63 to control the flow of fluid to, and the exhaust of fluid from, the cylinders in the half capacity setting of the valve spool 63 in which the spool is displaced to the right in FIG. 14 from the full capacity setting of the spool illustrated in that figure, the alignment of the passageways in the spool then corresponding with that shown on line B—B in FIG. 14. As there shown, adjacent pairs of ports P1 to P12 are now joined together in alternate pairs around the circumferential surface of the valve spool 63 by grooves 85, the grooves 85 being interconnected by radial holes 86 in the valve spool to interconnect the grooves 85 in one intermediate pressure zone.

The motor assembly of FIGS. 14 and 15 functions as already described with reference to FIGS. 11, 12 and 13.

In the arrangement of FIGS. 14 and 15 the pattern of grooves and holes is symmetrical about the peripheral surface of the valve spool 63. The spool is not, therefore, subject to any radial imbalance of forces from uneven pressure distribution around the sealing lands.

The hydraulic motor assembly shown in FIG. 16 is again generally as described in British Pat. Nos. 1,413,107 and 1,413,108 and parts corresponding with parts already described with reference to FIGS. 11 to 15 are indicated by corresponding reference numerals and will not be further described.

Referring to FIGS. 6 and 7 which diagrammatically illustrate the fluid flow paths for reduced capacity settings of the present motor, it is first to be noted that settings of one third and two thirds capacity are available. Single cam lobes are to be isolated in the intermediate pressure zones in this embodiment with the consequence that, since there are three cam lobes present, there is the option to isolate one cam lobe and operate two as shown in FIG. 6 or to isolate two cam lobes and operate one, as shown in FIG. 7. A three position valve spool 91 (FIG. 16) having again, a different pattern of holes and grooves is required to control the flow of fluid to, and the exhaust of fluid from, the motor cylinders in the reduced capacity settings of the valve spool. To reduce the fluid flow capacity to two thirds, the spool is displaced to the right in FIG. 16 from the full capacity setting of the spool as shown, to a first rightwards position, the alignment of the passageways in the spool then corresponding with that shown on line B—B in FIG. 17. To reduce the fluid flow capacity to one third, the spool is displaced further, to a second rightwards position, the alignment of the passageways in the spool then corresponding with that shown on line C—C in FIG. 17. In the first rightwards position of the valve spool, one pair of adjacent ports in the ring of ports P1 to P6 are now joined together by groove 92 and in the second rightwards position of the valve spool, four adjacent ports of the ring of ports P1 to P6 are joined together by the grooves 92, 93, 94. The narrow circumferential interconnecting groove 94 interconnecting the grooves 92 and 94 ensures uniformity of the intermediate pressure in the intermediate pressure zones Z during operation of the motor in either of the reduced capacity modes.

Each zone Z has associated restricters 54, 55 as previously described, formed in the wall of the pintle bore 69.

The second rightwards position of displacement of the spool 91 is determined by the dowel 65 engaging the left hand end of the slot 64 or other suitable stop means. The first rightwards position of displacement of the spool is midway between its first position and its second rightwards position. At this position, the edge of the right hand end face of the spool just cuts off a radial fluid flow passageway 96.

FIG. 18 illustrates a suggested hydraulic fluid circuit for the motor M1 of FIGS. 16 and 17. A three position valve V5 has first and second positions to switch the valve spool between its two extreme positions, in the manner generally as previously described with reference to FIG. 13, and a third position, as illustrated in FIG. 18, in which the right hand end of the valve spool 91 is supplied with fluid under pressure P through the fluid line 80, as before, and through a fluid line 97 communicating the radial passageway 96.

In the first position of the valve V5 both fluid lines 80 and 97 are communicated with the line 82 and the spring 62 displaces the spool 91 to its second rightwards position, fluid being supplied back into the motor case as before. In the second position of the valve V5, fluid pressure P is supplied via the line 80 to the right hand end of the valve spool 91 and the line 97 is communicated with the line 82. A flow of fluid therefore takes place into and out of the cavity 100 of the pintle bore 69 at the right hand end of the spool 91, restricted by an orifice 98 in the servo pressure supply line supplying fluid at pressure P. The pressure in the cavity 100 therefore falls and the spool 91 is displaced to the right in FIG. 16 until the edge of the right hand end face of the spool cuts off the passageway 96. This interrupts the through flow of fluid in the cavity 100 and allows the full fluid pressure P to build up in the cavity. As the pressure P attempts to move the spool 91 back to the left in FIG. 17, the spool once again uncovers the passageway 96. The spool 91 quickly achieves an equilibrium position with a small through flow of fluid in the cavity 100 in which the force of the spring 62 is balanced by an intermediate pressure of fluid in the cavity 100.

The motor assembly of FIGS. 16 to 18 may be modified by the provision of six instead of three cam lobes, to achieve a fluid flow path as illustrated in FIG. 8 or 9. Instead of one or two single cam lobes being isolated to achieve the reduced capacity settings, an adjacent pair and two adjacent pairs of cam lobes are isolated in the first rightwards position and the second rightwards position respectively of the valve spool using a pattern of holes or grooves in the valve spool as illustrated in FIG. 19.

In the construction of FIGS. 16 and 17 or FIGS. 16 and 19, the radial passageway 96 may be blanked off and the motor operated with a hydraulic fluid circuit as described with reference to, and as shown in, FIG. 13 to give 100% capacity or 33.3% capacity. Alternatively, the motor case end cap 101 could be provided with an end stop to engage the right hand end face of the spool 91 to allow the spool to move only to its mid position setting 66.6% capacity under the action of the spring 62. The fluid line 80 would then communicate through the radial passageway 96.

Referring now to FIGS. 20 and 21, the twelve pistons and cylinders of the motor assembly shown in FIG. 20 are arranged in two rows 110 and 111 of six pistons and cylinders and the pair of cams each having four cam lobes are indicated at 112 and 113, these cams controlling the movements of the pistons in the two rows 110, 111 of pistons and cylinders respectively. Thus, the fluid flow paths for a one half capacity setting for each row of pistons and cylinders are as shown in FIG. 3.

As indicated in FIG. 21, the valve spool 115 shown in FIG. 20 has four positions of stepwise adjustment in this embodiment.

The hydraulic motor assembly is generally as described in British Pat. Nos. 1,413,107 and 1,413,108 and parts already described with reference to earlier figures herein will not be further described.

As well as connecting each row of pistons and cylinders 110, 111 in a one half capacity mode it is contemplated that a free-wheel mode will be used to render one row of pistons and cylinders completely inoperative.

The spool 115 is illustrated in its fully capacity mode in FIG. 20. Two axially spaced radial fluid passageways 120, 121 communicate with the cavity 100 in this example. The capacity of the motor is reduced in steps of one half row of cylinders by operating the first row 110 at half capacity in the first displaced position of the spool 115 to the right in FIG. 20, set by the passageway 120, in the free-wheel mode in the second displaced position of the spool 115 to the right in FIG. 20, set by the passageway 121, and finally by operating the second row 111 of cylinders at half capacity in the third displaced position of the spool 115 to the right in FIG. 20, set by the dowel 65 engaging the left hand end of the slot 64 in FIG. 20, the first row of pistons and cylinders still being operated in the free-wheel mode.

In order to achieve the free-wheel mode, a small elevated pressure is generated in the motor case cavity 124 to hold the pistons at the radially inner ends of the cylinder bores, with the cylinders being vented as at 125 to atmospheric pressure, via passages 126 and 127 and holes 128 in the valve spool 115.

The suggested hydraulic circuit is shown in FIG. 22. Two position valve V6 changes the spool between its extreme left and right positions as described with reference to FIG. 13, the passageways 120,121 then being closed off at the three position valve V7. With the valve V6 set in its position as indicated, adjustment of the valve V7 communicates one or both passageways 120, 121 with the case drain line 82 via fluid lines 130, 131. A variable orifice 133 in a fluid line 134 bleeds fluid pressure into the motor case cavity 124 via the drain line 82 under the control of a non-return, pressure relief valve V8 and fluid line 140 connects the vent 125 to tank T at atmospheric pressure. Orifice 98 previously described is replaced by a variable orifice 98′ which serves the same purpose as the orifice 98.

Other possible configurations of four speed, two row motors according to the invention could employ two lobes per cam as in FIG. 4 to control six pistons and cylinders in each row or again six lobes per cam as in FIG. 5 with eight pistons and cylinders in each row.

Further combinations allowing even larger numbers of speed variations are clearly possible, including combinationss of rows of unequal total capacity.

Referring now to FIG. 23, this shows a two speed hydraulic motor assembly generally as described with reference to FIG. 11 but in which the biasing spring 62 is replaced by a hydraulic piston and cylinder 150, 151. The piston 150 engages the end cap 153 screwed into the end of the pintle bore. Fluid at inlet pressure I is supplied into the cylinder 151 through a change over ball valve 155 to displace the valve spool 63′ of the two speed valve mechanism 60′ of its half capacity, i.e. reduced torque, high speed setting when the case cavity 100 at the right hand end of the valve spool is vented to the case drain line 82. When the cavity 100 is fed with pressure fluid at pressure P the spool 63′ is displaced to the position indicated in FIG. 23. The hydraulically biased spool valve arrangement of FIG. 23 may be adapted to the motor assembly of FIGS. 11 to 13 or FIGS. 14 and 15 or FIGS. 16 to 19 or FIG. 20 in replacement of the spool biasing spring.

FIG. 24 shows a further two speed hydraulic motor assembly generally as described with reference to FIG.

11 but in which the valve spool 63" is arranged to be mechanically actuated to displace the spool between its two set positions by means of a hand lever 160. The cavity 100 is vented to the motor case via a conduit 161. If the valve spool has to have an intermediate position or positions, when adapting this mechanical arrangement to the motor assemblies of the other figures, the mechanical connection 163 could be operated through a gate or detents could be provided on the axial extension rod 164 of the spool.

The present invention relates to hydraulic piston and cylinder machines of the type referred to at the beginning. The consequence of designing machines of this type so that the forces acting on the pistons (and reacting on the cam lobes) are balanced, for full capacity operation of the machine, and so that a constant rate of displacement of working fluid is achieved, to provide a theoretically constant torque when the machine is operated as a motor, is that symmetrical groups of pistons and cam lobes have to be arranged so that their reaction forces always balance and each group of pistons has, therefore, its own constant rate of displacement. By by-passing one or more of these individual groups of pistons and cylinders in an intermediate pressure zone, a constant rate of displacement is maintained for the high speed low torque settings. It is for this reason that a 50% capacity setting has been described for configurations of motors employing six pistons and cylinders and four cam lobes, eight pistons and cylinders and six cam lobes, and ten pistons and cylinders and six cam lobes and a 33.3% or a 66.6% capacity setting has been described for configurations of motors employing nine pistons and cylinders and three or six cam lobes.

The following table indicates the reduced capacity potential with uniform displacement for specific embodiments of hydraulic fluid machines according to the present invention, and the out of balance force which occurs for a by-pass loop pressure of 50% of the inlet pressure.

This is compared with the out of balance force which occurs in an equivalent "closed" system for stepping the motor capacity in which the closed system pressure is zero.

| Basic motor geometry | | | Cam Angles | | | | Piston worths of out-of-balance force | | Equivalent closed system Pistons worth of out-of-balance force |
|---|---|---|---|---|---|---|---|---|---|
| Pistons & Cylinders | Cam lobes | Rows | Acceleration | Constant Velocity | Deceleration | % Flow | | Time % | |
| 6 | 2 | 1 | 30° | 30° | 30° | 50 | 1.0 | 100% | 1.0 to 1.732 |
| 9 | 3 | 1 | 20° | 20° | 20° | 33.3 | 0.663 | 100% | 1.0 to 1.879 |
| 9 | 3 | 1 | 20° | 20° | 20° | 66.6 | 0.663 | 100% | 1.0 to 1.879 |
| 6 | 4 | 1 | 15° | 15° | 15° | 50 | 1.0 | 50% | 1.0 to 1.732 |
| 12 | 4 | 2 | 15° | 15° | 15° | 75 | 1.0 | 50% | 1.0 to 1.732 |
| 12 | 4 | 2 | 15° | 15° | 15° | 50 | 0 | 100% | 0 |
| 12 | 4 | 2 | 15° | 15° | 15° | 25 | 1.0 | 50% | 1.0 to 1.732 |
| 8 | 6 | 1 | 15° | 0° | 15° | 50 | 0.541 | 100% | 0.765 |
| 9 | 6 | 1 | 10° | 10° | 10° | 33 | 0.266 | 50% | 1.0 to 1.879 |
| | | | | | | | 0.814 | 50% | |
| 9 | 6 | 1 | 10° | 10° | 10° | 66 | 0.266 | 50% | 1.0 to 1.879 |
| | | | | | | | 0.591 | 25% | |
| | | | | | | | 0.814 | 25% | |
| 10 | 6 | 1 | 6° | 18° | 6° | 50 | 0 | 33% | 0.382 to 1.125 |
| | | | | | | | 0.618 | 33% | |
| | | | | | | | 1.0 | 33% | |
| 10 | 6 | 2 | 6° | 18° | 6° | 50 | 0 | 33% | 0.382 to 1.125 |
| | | | | | | | 0.618 | 33% | |
| | | | | | | | 1.0 | 33% | |
| 16 | 6 | 2 | 15° | 0 | 15° | 75 | 0.541 | | 0.765 |
| | | | | | | 50 | 0 | | 0 |
| | | | | | | 25 | 0.541 | | 0.765 |

With machines of the present invention, since working fluid is continuously exchanged between the main hydraulic fluid circuit and a temporary by-pass loop or loops, any tendency to heat build-up in the increased speed phase or phases of the machine is eliminated. This removes restrictions on high speed motors and allows higher internal fluid flow velocities in the motor to be employed. This compares favourably with a prior art closed loop system for stepping capacity in which the major losses are flow induced losses which are approximately proportional to the flow velocity squared.

Although noise is not normally a problem with low speed hydraulic motors, it can become noticeable at higher speeds. Noise arises in the main from the uncontrolled release of high pressure fluid in each cylinder when it becomes connected with the exhaust fluid outlet of the motor. With machines according to the present invention, in the high speed phase or phases, the pressure will be released in two stages from high pressure to the intermediate pressure and from the intermediate pressure to zero. This has the effect of reducing noise at the higher speeds.

While it is preferred to control the by-pass loop pressure to 50% of the inlet pressure to maintain symmetry for equal reverse performance and manufacturing economy, the invention is not restricted to this feature and it is thought to be possible that the out of balance force for operation at reduced capacity, starting with a motor in which all piston forces are balanced in a radial sense for full capacity operation and given that a constant rate of displacement such that the sum of the velocities of the pistons remains constant is a requirement, might well be further reduced by controlling the intermediate temporary by-pass loop pressure at something other than half way between the fluid inlet pressure and the fluid exhaust pressure.

It will be appreciated that the present invention is also not limited to hydraulic piston and cylinder machines having only a small number of pistons and cylinders but that it may be applied to machines having a higher number of pistons and cylinders arranged in one or more rows.

In the two row motor configurations it is not necessary that the two rows of pistons and cylinders should be placed in axially spaced side by side relation as illustrated in FIG. 20. Instead, the two rows of pistons and cylinders could be nested in a staggered formation to achieve a more compact axial length of motor.

While only radial piston and cylinder machines have been specifically described, the present invention may be applied to hydraulic piston and cylinder machines in which the cylinders are disposed with their axes parallel to one another in a circular array, a multi-lobe face cam being used to control the displacement of the pistons in their cylinders.

I claim:

1. In a hydraulic piston and cylinder machine comprising a plurality of pistons and cylinders, a ring of ports for alternatively supplying working fluid into, and for allowing said fluid to be discharged from each cylinder, and a cam having a plurality of lobes to control the displacement of the pistons in a cylinder block with respect to relative progression of the cylinder block along the direction of the cam and in which each of the pistons traverses each of the cam lobes during a full rotation of the machine to undergo a number of piston strokes equal to the number of lobes, the improvement comprising:

valve means adjustable to route working fluid discharged through at least one of a number of fluid discharge ports of the machine cylinders to an exhaust fluid outlet of the machine during each full rotation of the machine, the discharge fluid being conducted to said exhaust fluid outlet through an isolated pressure zone of the machine;

said valve means including a displaceable valve element having passageways forming a part of said isolated pressure zone;

said isolated pressure zone also including, at any given time, the cylinders associated with at least one pair of pistons of the machine which pistons and cylinders discharge to and draw working fluid from other portions of said isolated pressure zone, wherein the total volume of said isolated pressure zone is constant during operation of the machine to reduce the capacity of the machine to receive and discharge working fluid; and means for maintaining the pressure of the working fluid in said isolated pressure zone at all times during machine operation, at a pressure intermediate and a predetermined function of the supply and exhaust pressures of working fluid to and from the machine.

2. A machine as claimed in claim 1 in which the sum of the velocities of all the pistons remains constant for a constant speed of rotation of the machine, the cam lobes are all of identical shape and size, the cam has a symmetrical form, the pistons and cylinders are all identically proportioned and symmetrically arranged such that the vector sum of the forces acting on the pistons due to the working fluid pressure is balanced in all positions of rotation of the machine during full capacity operation of the machine, and a constant rate of displacement of working fluid is maintained for reduced capacity operation of the machine.

3. A machine as claimed in claim 2 in which the valve means is a two speed valve mechanism and the capacity of the machine to receive and discharge working fluid is reduced by one half or by one third or by two thirds when working fluid is routed through said isolated pressure zone by said valve means.

4. A machine as claimed in claim 2 in which said valve means is a three speed valve mechanism and the capacity of the machine to receive and discharge working fluid is reduced by one third in an intermediate speed setting of said valve means to route working fluid through said isolated pressure zone of the machine and by two thirds in a high speed setting of said valve means to route working fluid through said isolated pressure zone of the machine, the valve means, at any given time, isolating different numbers of cylinders of the pistons and cylinders of the machine in said isolated pressure zone in its intermediate and high speed settings respectively.

5. A machine as claimed in claim 1 in which said pressure maintaining means maintains the intermediate pressure of fluid in said isolated pressure zone during reduced capacity operation of the machine approximately half way between the pressure of working fluid supplied to the machine and the pressure of fluid exhausting from the machine, when the machine is operated as a motor.

6. A machine as claimed in claim 5 in which the intermediate pressure maintaining means comprises a pair of differential control valves each comprising an axially slidable, stepped cylindrical spool in a stepped cylindrical bore and presenting a larger end face in a blind end of the bore, the other end of which bore opens to atmospheric pressure, and the larger end face is opposed by an annular face of the spool of one half the area of the end face, the annular face being exposed in the bore at an intermediate portion of the bore, the open end of the bore being closed by the spool, the spool having a passage opening at one end in its end face which passage communicates with branch passages at two axially spaced ports in its cylindrical surface on the side of its annular face remote from its end face, the branch passage communicating the passage with the port which is adjacent the open end of the bore containing a restrictor to restrict the flow of fluid through the port when the port is uncovered by the bore, the blind ends of the bores being communicated with said intermediate pressure zone, and further passages being formed in the machine for communicating with the intermediate bore portions to expose the annular faces with the fluid pressure inlet and the exhaust fluid outlet respectively.

7. A machine as claimed in claim 5 in which the intermediate pressure maintaining means comprises a differential control valve comprising an axially slidable, stepped cylindrical spool in a stepped cylindrical bore and presenting a larger end face in a blind end of the bore, the other end of which bore opens to atmospheric pressure, and the larger end face is opposed by an annular face of the spool of one half the area of the end face, the annular face being exposed in the bore at an intermediate portion of the bore, the open end of the bore being closed by the spool, the spool having a passage opening at one end in its end face which passage communicates with branch passages at two axially spaced ports in its cylindrical surface on the side of its annular face remote from its end face, the branch passage communicating the passage with the port which is adjacent the open end of the bore containing a restrictor to restrict the flow of fluid through the port when the port is uncovered by the bore, the blind end of the bore being communicated with said intermediate pressure zone, a further passage being formed in the machine for communicating with the intermediate bore portion to expose the annular face with the fluid pressure inlet.

8. A machine as claimed in claim 7, including change-over valve means arranged to be operated by the inlet fluid pressure for communicating said further passage with the fluid pressure inlet.

9. A machine as claimed in claim 5 in which the intermediate pressure maintaining means comprises restrictors to limit the flow of working fluid through passages communicating the fluid pressure inlet of the machine and the exhaust pressure outlet of the machine respectively with the intermediate pressure zone.

10. A machine as claimed in claim 9 in which the restrictors are formed by grooves or drillings in the wall of a valve bore of said valve means housing a valve spool, the grooves or drillings opening at one end into said intermediate pressure zone and at the other end respectively into one of said ports of said ring of ports communicating with the exhaust fluid outlet of the machine and one of said ports of said ring of ports communicating with the pressure fluid inlet of the machine, when the machine is operated as a motor.

11. A machine as claimed in claim 1 in which at least two of said rings of ports for alternatively supplying fluid into and for allowing it to be discharged from each cylinder of respective rows of pistons and cylinders are provided, and at least two of said cams, one to control the displacement of the pistons of each of said respective rows of pistons and cylinders, and said valve means is a multiple speed valve mechanism having a first intermediate speed setting in which the capacity of the machine to receive and discharge working fluid is reduced by routing working fluid discharged through at least one of the fluid discharge ports of one of said rings of ports of the machine during each full rotation of the machine through said isolated pressure zone of the machine, said isolated pressure zone being of constant volume and always including, at any given time, the cylinders associated with at least two pistons of the row of pistons and cylinders associated with said one of said rings of ports of the machine, a further intermediate speed setting in which the capacity of the machine to receive and discharge working fluid is further reduced by rendering all the cylinders of the row of pistons and cylinders associated with said one of said rings of ports of the machine inoperative to receive and discharge working fluid at the supply and exhaust pressures of working fluid to and from the machine, and a higher speed setting in which the capacity of the machine to receive and discharge working fluid is still further reduced by routing working fluid discharged through at least one of the fluid discharge ports of a further one of said rings of ports of the machine during each full rotation of the machine through a further isolated pressure zone of the machine in which the pressure is maintained at a pressure intermediate the supply and exhaust pressures of working fluid to and from the machine, said further isolated pressure zone being of constant volume and always including, at any given time, the cylinders associated with at least two pistons and of the row of pistons and cylinders associated with said further one of said rings of ports of the machine.

12. A machine as claimed in claim 11 in the sum of the velocities of all the pistons of each of said rows of pistons and cylinders remains constant for a constant speed of rotation of the machine, the cam lobes of each of said cams are all of identical shape and size, each cam has a symmetrical form, the pistons and cylinders of each row of pistons and cylinders are all identically proportioned and symmetrically arranged such that the vector sum of the forces acting on the pistons of each row of pistons and cylinders due to the working fluid pressure is balanced in all positions of rotation of the machine during full capacity operation of each row of pistons and cylinders of the machine, and a constant rate of displacement of working fluid is maintained for reduced capacity operation of each row of pistons and cylinders of the machine.

13. A machine as claimed in claim 11 in which said pressure maintaining means maintains the intermediate pressure of fluid in the first said isolated pressure zone of the machine during operation of the machine at first said intermediate speed setting halfway between the pressure of working fluid supplied to the machine and the pressure of fluid exhausting from the machine, when the machine is operated as a motor, and including means for maintaining the intermediate pressure of fluid in said further isolated pressure zone of the machine during operation of the machine at said further intermediate speed setting halfway between the pressure of working fluid supplied to the machine and the pressure of fluid exhausting from the machine, when the machine is operated as a motor.

14. A machine as claimed in claim 13 in which the intermediate pressure maintaining means each comprises a pair of differential control valves each comprising an axially slidable, stepped cylindrical spool in a stepped cylindrical bore and presenting a larger end face in a blind end of the bore, the other end of which bore opens to atmospheric pressure, and the larger end face is opposed by an annular face of the spool of one half the area of the end face, the annular face being exposed in the bore at an intermediate portion of the bore, the open end of the bore being closed by the spool, the spool having a passage opening at one end in its end face which passage communicates with branch passages at two axially spaced ports in its cylindrical surface on the side of its annular face remote from its end face, the branch passage communicating the passage with the port which is adjacent the open end of the bore containing a restrictor to restrict the flow of fluid through the port when the port is uncovered by the bore, the blind ends of the bores being communicated respectively with the first said isolated pressure zone and said further isolated pressure zone, and further passages being formed in the machine for communicating with the intermediate bore portions to expose the annular faces with the fluid pressure inlet and the exhaust fluid outlet respectively.

15. A machine as claimed in claim 13 in which the intermediate pressure maintaining means each comprises restrictors to limit the flow of working fluid through passages communicating the fluid pressure inlet of the machine and the exhaust pressure outlet of the machine respectively with the respective isolated pressure zones.

16. A machine as claimed in claim 15 in which the restrictors are formed by grooves or drillings in the wall of a valve bore of said valve means housing a valve spool, the grooves or drillings opening at one end into the respective intermediate pressure zones and at the other end respectively into one of said ports of said respective rings of ports communicating with the exhaust fluid outlet of the machine and one of said ports of said respective rings of ports communicating with the pressure fluid inlet of the machine, when the machine is operated as a motor.

* * * * *

UNITED STATES PATENT AND TRADEMARK OFFICE

CERTIFICATE OF CORRECTION

PATENT NO. : 4,532,854

DATED : August 6, 1985

INVENTOR(S) : Kenneth W. S. FOSTER

It is certified that error appears in the above-identified patent and that said Letters Patent is hereby corrected as shown below:

Column 19 (claim 11), line 60, after "pistons" delete "and".

Signed and Sealed this

*Eighth* Day of *July 1986*

[SEAL]

*Attest:*

DONALD J. QUIGG

*Attesting Officer*

*Commissioner of Patents and Trademarks*